US006619432B1

(12) United States Patent
Yasui

(10) Patent No.: US 6,619,432 B1
(45) Date of Patent: Sep. 16, 2003

(54) OBJECT TRANSPORT APPARATUS, DRIVE MECHANISM FOR OBJECT TRANSPORT APPARATUS AND METHOD OF USING OBJECT TRANSPORT APPARATUS

(75) Inventor: Takako Yasui, 5-405, Mameda-cho, Nishikyogoku, Ukyo-ku, Kyoto-shi, Kyoto (JP)

(73) Assignees: Takako Yasui, Kyoto (JP); Hirokazu Yasui, Kyoto (JP)

( * ) Notice: Subject to any disclaimer, the term of this patent is extended or adjusted under 35 U.S.C. 154(b) by 0 days.

(21) Appl. No.: 09/743,550

(22) PCT Filed: Jul. 8, 1999

(86) PCT No.: PCT/JP99/03695

§ 371 (c)(1),
(2), (4) Date: Jan. 9, 2001

(87) PCT Pub. No.: WO00/02807

PCT Pub. Date: Jan. 20, 2000

(30) Foreign Application Priority Data

Jul. 10, 1998 (JP) ..... 10-195645

(51) Int. Cl.[7] ..... G65H 51/14

(52) U.S. Cl. ..... 187/250; 226/170; 226/172; 182/133; 74/665 GC

(58) Field of Search ..... 187/250, 271; 74/665 A, 665 GC, 420; 198/617; 182/133, 187; 226/170, 172

(56) References Cited

U.S. PATENT DOCUMENTS

| | | | | |
|---|---|---|---|---|
| 3,984,007 A | | 10/1976 | Birdwell | |
| 4,008,785 A | | 2/1977 | Mugnaini | |
| 4,285,454 A | | 8/1981 | Plumettaz | |
| 5,319,418 A | * | 6/1994 | Fujimoto et al. | 74/665 GC |

FOREIGN PATENT DOCUMENTS

| | | | | |
|---|---|---|---|---|
| DE | 2542418 | | 4/1976 | |
| EP | 0006097 | | 1/1980 | |
| JP | 47-47200 | | 11/1972 | |
| JP | 55101554 | | 8/1980 | |
| JP | 56-65765 A | * | 6/1981 | |
| JP | 61-32707 | | 2/1986 | |
| JP | 61-207111 | | 9/1986 | |
| JP | 61-165011 | | 10/1986 | |
| JP | 61-282265 A | * | 12/1986 | 226/170 |
| JP | 4-303365 A | * | 10/1992 | |
| JP | 5-338911 A | * | 12/1993 | 226/172 |
| NL | 6912251 | | 2/1971 | |

* cited by examiner

*Primary Examiner*—Eileen D. Lillis
*Assistant Examiner*—Thuy V. Tran
(74) *Attorney, Agent, or Firm*—W. F. Fasse; W. G. Fasse

(57) ABSTRACT

A cable transport apparatus (1) has a first rotational axis (20*a*, 20*c*) and a second rotational axis (20*b*, 20*d*) that are not in parallel but cross each other with a predetermined angle therebetween. In this way, a V-shaped space is formed between transport belts (40*a*, 40*b*). The cable transport apparatus (1) can thus transport a thin cable (100) being in contact with the lower part of the V-shaped space and transport a thick cable (200) being in contact with the upper part thereof. Even if cables to be transported have respective successively increasing diameters, such cables can be transported using the same apparatus. Further, the cables never escape from the cable transport apparatus and can be transported without lowering the transport speed of the cables.

13 Claims, 24 Drawing Sheets

OBJECT TRANSPORT APPARATUS, DRIVE MECHANISM FOR OBJECT TRANSPORT APPARATUS AND METHOD OF USING OBJECT TRANSPORT APPARATUS

TECHNICAL FIELD

The present invention relates to apparatuses for transporting objects and particularly to an object transport apparatus used for transporting objects with their cross sections different in size from each other.

BACKGROUND ART

A cable transport apparatus 101 as shown in FIGS. 24–26 has been employed for installing an electric cable by using a temporary overhead cable or for installing an electric cable in an underground pipe. This cable transport apparatus 101 is used as shown in FIG. 23 by being mounted on a support platform 210 that is placed on the lower part of a utility pole 160.

According to a method of using this cable transport apparatus 101 on an installation site, an electric cable 200 is transported by being successively fed to the left in FIG. 23 by cable transport apparatus 101 to the extent that tension is generated on electric cable 200 while electric cable 200 is hung on rings 180 provided on a temporarily installed overhead cable 170 that is suspended on respective top parts of poles 160. Then, electric cable 200 is removed from a pulley 220 when cable transport apparatus 101 causes electric cable 200 to fall in a state of tension, and this cable transport apparatus 101 is further used to successively feed electric cable 200 to the left by using a next pole (located further to the left of FIG. 23). This operation is repeated for each pole to accordingly install electric cable 200 on each pole. It is noted that a cable transport apparatus 2 used in a second embodiment of the present invention is employed in FIG. 23.

A structure of this cable transport apparatus 101 is now described in conjunction with FIGS. 24 and 25. As shown in FIGS. 24 and 25, cable transport apparatus 101 is constructed of a pedestal 110 and a transport unit 105. A power unit is provided within pedestal 110. Further, transport unit 105 has rotational axes 120*a*, 120*b*, 120*c* and 120*d* on a main surface of pedestal 110. Around rotational axes 120*a*, 120*b*, 120*c* and 120*d*, there are provided wheels 125*a*, 125*b*, 125*c* and 125*d* for conveying turning forces of rotational axes 120*a*, 120*b*, 120*c* and 120*d* and transport belts 140*a* and 140*b* for conveying turning forces of rotating wheels 125*a*, 125*b*, 125*c* and 125*d* by means of frictional forces on the peripheries of wheels 125*a*, 125*b*, 125*c* and 125*d*.

In use of cable transport apparatus 101, a turning force of a motor causes wheels 125*a* and 125*b* to rotate about respective rotational axes 120*a* and 120*b* in opposite directions respectively. At this time, respective turning forces of wheels 125*a* and 125*b* are conveyed from the peripheries of wheels 125*a* and 125*b* to transport belts 140*a* and 140*b* respectively, and transport belts 140*a* and 140*b* then circulate respectively around wheels 125*a* and 125*c* and 125*b* and 125*d*. Frictional forces on the surface of circulating transport belts 140*a* and 140*b* feed electric cable 200 shown in FIG. 23 in the direction of transportation. At this time, wheels 125*c* and 125*a* rotate in the same direction while wheels 125*d* and 125*b* rotate in the same direction. Wheels 125*b* and 125*d* rotate in directions opposite to each other to assist transport belts 140*a* and 140*b* in circulating in opposite directions respectively.

A cable transport apparatus 102 as shown in FIGS. 27 and 28 is another cable transport apparatus having a transport unit structured differently from that of the above cable transport apparatus 101. Cable transport apparatus 102 includes as its transport unit spherical wheels 225*a* and 225*b* provided around rotational axes 220*a* and 220*b* as shown in FIGS. 27 and 28 on the main surface of pedestal 110 shown in FIG. 24 for conveying the turning force of the power unit. Spherical wheels 225*a* and 225*b* are formed of rubber containing therein air or the like, with their peripheral surfaces deformable according to the diameter of an electric cable. The electric cable is fed in a certain direction by a frictional force between spherical wheels 225*a* and 225*b* and the electric cable.

As for cable transport apparatus 101 shown in FIGS. 24 and 25, the distance W1 between rotational axes 120*a* and 120*b* and the distance W1 between rotational axes 120*c* and 120*d* are constant and thus the gap W2 between transport belts 140*a* and 140*b* is also constant. Therefore, if both of a thin cable 100 and a thick cable 200 are used simultaneously, cable transport apparatuses 101 should separately be prepared to be available all the time for respective thin cable 100 and thick cable 200 in order to employ the apparatuses according to need on an installation site.

If only one cable transport apparatus 101 is used for both of thin cable 100 and thick cable 200, cable transport apparatus 101 should have another mechanism capable of changing the distance W1 between rotational axes 120*a* and 120*b* and between axes 120*c* and 120*d*.

If the diameter of thin cable 100 is smaller than the distance W2 between transport belts 140*a* and 140*b*, thin cable 100 could deviate in the direction of the arrows as shown in FIG. 25. Consequently, cable 100 could meander up and down between transport belts 140*a* and 140*b* as shown in FIG. 26 which results in a lower transport speed. Alternatively, if thin cable 100 significantly deviates in the direction of the arrow, thin cable 100 would escape from the part between transport belts 140*a* and 140*b*.

For installation of a thick electric cable, usually a thin rope is first installed temporarily for drawing the thick cable to be installed actually, and the thick cable 200 is pulled via an adapter on the end of the rope having both ends to which respective ends of the rope and the cable with different diameters can be attached, the adapter having its diameter changing continuously. In this case, cable transport apparatus 101 should temporarily be stopped for replacing it with another cable transport apparatus having a greater distance between transport belts 140*a* and 140*b*on the installation site. Such a replacement of cable transport apparatus 101 on the installation site is laborious and deteriorates working efficiency.

Cable transport apparatus 102 shown in FIGS. 27 and 28 is employed as one conventional art for solving the problem above. Cable transport apparatus 102 includes spherical wheels 225*a* and 225*b* that deform according to the diameter of thin cable 100 and thick cable 200 in order to allow both of thin cable 100 and thick cable 200 to successively be fed without changing the distance W3 between rotational axes 220*a* and 220*b*, i.e., without employing another cable transport apparatus, and without employing any mechanism for changing the distance between rotational axes 220*a* and 220*b*.

Although this cable transport apparatus 102 can transport an object or cable according to the diameter of the cable if the diameter is in a predetermined range, an extremely thin cable 100 could deviate in the directions indicated by the arrows shown in FIG. 27 because of the ball-like shape of spherical wheels 225*a* and 225*b*, so that cable 100 escapes from spherical wheels 225*a* and 225*b*. On the other hand, if cable 200 is thick enough to dramatically change the shape of spherical wheels 225*a* and 225*b*, spherical wheels 225*a* and 225*b* deform greatly to increase rotational resistance that hinders rotation of spherical wheels 225*a* and 225*b*. Consequently, the feeding speed of thick cable decreases. In order to reduce the rotational resistance, another mechanism should be provided for changing the distance W3 between rotational axes 220*a* and 220*b* as employed by cable transport apparatus 101.

DISCLOSURE OF THE INVENTION

The present invention is made to solve the problems above. One object of the present invention is to provide a cable transport apparatus for electric cables and the like, which can be applied to the case in which both of thin and thick electric cables are successively used, without the trouble of replacement of the apparatus on site and without escape of electric cables from the cable transport apparatus, and which can transport cables without reduction in cable transport speed.

An object transport apparatus according to one aspect of the invention transports an object by keeping contact with a part of the peripheral surface of the object and using frictional force between respective peripheral surfaces of at least two rotating transport members and the part of the peripheral surface of the object. The object transport apparatus includes the structure below.

Specifically, the object transport apparatus according to the one aspect of the invention includes a pedestal having continuing first and second surfaces with a predetermined angle therebetween, transport unit provided on the first and second surfaces respectively and keeping contact with a part of the peripheral surface of an object for transporting the object, and drive means for rotationally driving the transport unit in an object transport direction.

The transport unit includes first power transmission means having a plurality of first cylindrical members rotating about a plurality of rotational axes respectively that are substantially perpendicular to the first surface and in parallel with each other, second power transmission means having a plurality of second cylindrical members rotating about a plurality of rotational axes respectively that are substantially perpendicular to the second surface and in parallel with each other, and first and second belt-like transport members contacting or winding around respective peripheral surfaces of the first and second cylindrical members of respective first and second power transmission means to circulate respectively around the first and second power transmission means.

This structure allows the rotational axes to cross at a predetermined angle so that the first and second power transmission means form a V-shaped space between the first and second belt-like transport members. Accordingly, an object to be transported having a small diameter can be transported by keeping contact with the lower part of the V-shape and an object to be transported having a large diameter can be transported by keeping contact with the upper part of the V-shape, both of the objects being transported by frictional force generated between the objects and the first and second belt-like transport members. In this way, just the difference in dimension between the upper and lower parts of the V-shape can be increased for consecutively transporting objects having respective diameters ranging from smaller one to larger one, without addition of another mechanism and without replacement of the object transport apparatus.

Not only the first and second power transmission means but the first and second belt-like transport members are provided to increase the contact area with the object. The frictional force between the object and the first and second belt-like transport members is thus increased. Consequently, there is less possibility of idle rotation of the first and second power transmission means and thus the object can be transported in a more stable state.

More preferably, in the object transport apparatus according to the one aspect of the invention, the first belt-like transport member has one side, on the pedestal, of a transport surface contacting the object and the second belt-like member has one side, on the pedestal, of a transport surface contacting the object, respective one sides being in parallel and adjacent to each other.

This structure provides a reduced width of the gap between the first and second belt-like transport members, on the pedestal, in the V-shaped space formed by the first and second belt-like transport members. Accordingly, even if the object has a small diameter, the object can be prevented from escaping from the gap during transportation.

A cable transport apparatus according to another aspect of the invention transports an object by keeping contact with a part of the peripheral surface of the object and using frictional force between respective peripheral surfaces of at least two rotating transport members and the part of the peripheral surface of the object. The object transport apparatus includes the structure below.

Specifically, the cable transport apparatus according to the another aspect of the invention includes a pedestal having continuing first and second surfaces with a predetermined angle therebetween, transport unit provided on the first and second surfaces respectively and keeping contact with a part of the peripheral surface of an object for transporting the object, and drive means for rotationally driving the transport unit in an object transport direction.

The transport unit includes first power transmission means having a first cylindrical member rotating about a first rotational axis substantially perpendicular to the first surface, and second power transmission means having a second cylindrical member rotating about a second rotational axis crossing the first rotational axis and substantially perpendicular to the second surface.

This structure allows the first and second rotational axes to cross each other and thus form a V-shaped space between the first and second power transmission means. An object having a small diameter can be transported by keeping contact with the lower part of the V-shape and an object having a large diameter can be transported by keeping contact with the upper part of the V-shape. In this way, just the difference in dimension between the upper and lower parts of the V-shaped space can be increased for successively transporting objects having respective diameters ranging from smaller one to larger one, without additional mechanism and without replacement of the object transport apparatus.

More preferably, in the object transport apparatus according to the another aspect of the invention, the first cylindrical member as a component of the first power transmission means has one edge portion, on the pedestal, and the second cylindrical member as a component of the second power transmission means has one edge portion, on the pedestal, respective edge portions being adjacent to each other.

This structure provides a reduced gap on the pedestal between the first cylindrical transport member and the second cylindrical transport member in the V-shaped space formed by the first and second cylindrical transport members. It is thus possible to prevent an object being transported from escaping from the gap during transport even if the object has a small diameter.

The object transport apparatus according to the one aspect of the invention may further include object press means having a third cylindrical transport member with its peripheral surface pressing a transported object, the third cylindrical transport member being provided to be rotatable following transport of the object.

This structure has the object press means so that the object can be held without upward displacement in transport. At this time, the object press means rotates following the transport of the object and thus there is no remarkable reduction in cable transport speed. Even if the cable transport speed increases and the cable weaves in the V-shaped space, escape can be prevented of the cable from the V-shaped space between the first and second belt-like transport members. Stable transportation of an object is thus possible even if the transport speed of the object increases.

Still more preferably, the object transport apparatus according to the one aspect of the invention includes a plurality of object press means provided along a transport direction of an object.

This structure having a plurality of object press means enables an object to be transported more stably compared with the structure having one object press means.

Further, the object transport apparatus according to the one aspect of the invention preferably has the object press means including a support unit fixed to the pedestal and a press unit provided to turn around on one end of the support unit. The press unit can recede for stopping the press by being turned around.

In this structure, the press unit provided to turn around on one end of the support unit can recede for stopping the press. Therefore, in transport, loading and unloading of the object to and from the object transport apparatus is facilitated. The time required for installation on the site can accordingly be shortened.

The object transport apparatus according to the one aspect of the invention may have the object press means further including an external thread portion and an internal thread portion such that adjustment of the length of the external thread portion screwed into the internal thread portion allows the press unit to contact the object with an almost constant pressure.

In this structure, the object press means has the external thread portion which can be screwed into the internal thread to adjust the screwed length. Therefore, objects having respective diameters ranging from a smaller one to a larger one can be handled without replacement of the means. Consequently, reduction in installation time on the site is possible.

The object transport apparatus according to the one aspect of the invention may further include a third belt-like transport member circulating around the third cylindrical member following transport of the object while winding around or contacting the third cylindrical member.

The third belt-like transport member provided around the third cylindrical member allows the area of contact between the transported object and the object press means to achieve more stable transport of the object.

The drive mechanism of the object transport apparatus according to the invention includes a first spur gear and a first bevel gear rotating about a common rotational axis by a drive force, a second bevel gear engaging with the first bevel gear, a second spur gear engaging with the first spur gear, a third bevel gear rotating integrally about a rotational axis common to the second spur gear, and a fourth bevel gear engaging with the third bevel gear.

In this structure, the drive force causes the first spur gear to rotate which rotates the first bevel gear in the same direction, which is fixed by one shaft to the first spur gear, and accordingly the second bevel gear rotates. The second spur gear rotates in the direction opposite to the rotational direction of the first spur gear, and accordingly the third bevel gear rotates in the direction opposite to the rotational direction of the first bevel gear. Then, the fourth bevel gear rotates. Consequently, the second and fourth bevel gears rotate in the opposite directions respectively, in the state in which respective rotational axes of the first and second bevel gears cross each other with a predetermined angle therebetween in a plane perpendicular to the rotational axes of the first and the second spur gears and the first and second bevel gears, if the angle of inclination of the employed bevel gears is 45°. In this way, the V-shaped space can be formed between the first and second power transmission means respectively having the first and second cylindrical members rotating about respective rotational axes of the second and fourth bevel gears. It is thus possible to successively transport small-diameter and large-diameter objects by holding the objects in the V-shaped space.

According to a method of using the object transport apparatus of the invention, the object transport apparatus of the one aspect of the invention discussed above is used by moving the apparatus up and down along a long pole-like object standing substantially perpendicularly to the ground. The object transport apparatus holds the long object with a predetermined press force at three portions, i.e., by the first and second belt-like transport members and the object press means, and the drive means is rotationally driven to move the object transport apparatus up and down along the long object by frictional force between the first and second belt-like members and the object press means and the long object.

The object transport apparatus according to the one aspect of the invention is used by such a method to enable the object transport apparatus to move up and down along an object to be transported, by the frictional force between the first and second cylindrical transport members or the first and second belt-like transport members and the object. Electric cable, safety rope, tools and the like, for example, can thus be conveyed to the top of a pole without human force.

According to a method of using the object transport apparatus of the invention, two object transport apparatuses of the type according to the one aspect of the invention may be used. The two object transport apparatuses are made opposite to each other such that respective sides contacting a transported object face each other, each side belonging to the first and second belt-like transport members. The object transport apparatuses are moved up and down along a long pole-like object standing perpendicularly to the ground by holding the long object between the first and second belt-like transport members of the two object transport apparatuses and rotationally driving the drive means to use frictional force of the transport members for moving the object transport apparatuses.

By this method of using the object transport apparatus according to the first aspect of the invention, the frictional force between the transported object and the first and second cylindrical transport members or the first and second belt-like transport members of the object transport apparatus can be used to move the object transport apparatus up and down along the long object. Cable, safety rope, tools and the like, for example, can thus be conveyed to the top of a pole without human force. In addition, two object transport apparatuses can be used to allow respective first and second cylindrical transport members or the first and second belt-like transport members to contact the transported object and thus the frictional force is increased compared with the contact of the three point, i.e., the object press means and the first and second cylindrical transport members or the first and second belt-like transport members. Therefore, even an object having a great weight can be moved up and down along the long object.

According to the method of using the object transport apparatus of the invention, in addition to the object transport apparatus of the first aspect of the invention, another object transport apparatus having the structure of that object transport apparatus of the first aspect may be used such that the object transport apparatuses are fixed with respective transport directions of the transport units being substantially perpendicular to each other and accordingly the another object transport apparatus transports an object substantially perpendicularly to the long object.

This method of use can be employed to move the object transport apparatus to the upper part of the long object and then transport an object substantially perpendicularly to the long object. In this way, a cable or the like can be installed, for example, on each pole by lifting the cable to the top of the pole and then transporting the cable perpendicularly to the pole. It is thus unnecessary for a person carrying a cable to climb to the top of the pole in order to install the cable.

More preferably, according to the method of using the object transport apparatus of the invention, the ratio between respective rotational speeds of the first and second power transmission means is changed to move the object transport apparatus in a helical manner up and down along the long object.

This method of use enables a rope or cable to be wound helically around the long object. A rope or the like can helically be wound around a pole or the like, for example, in order to prevent the rope from swaying due to blowing wind.

The above and other objects, characteristics, aspects and advantages of the present invention will become clear from the following detailed description of the invention understood in conjunction with the attached drawings.

BEST MODES FOR CARRYING OUT THE INVENTION

Embodiments of the present invention are hereinafter described in conjunction with the drawings.

First Embodiment

According to a first embodiment of the present invention, a structure of an object transport apparatus 1 used for transporting a cable is described in conjunction with FIGS. 1–6. Object transport apparatus 1 is constituted as shown in FIGS. 1–5 of a pedestal 10, a transport unit 5 and a drive unit 7.

Pedestal 10 is provided having surfaces 15*a* and 15*b* that continue to form the shape of chevron with a predetermined angle therebetween. Wheels 25*a* and 25*c* of transport unit 5 are provided on surface 15*a* with respective rotational axes 20*a* and 20*c* substantially perpendicular to surface 15*a*. Wheels 25*b* and 25*d* of transport unit 5 are also provided on surface 15*b* with respective rotational axes 20*b* and 20*d* substantially perpendicular to surface 15*b*. Rotational axes 20*a* and 20*c* are in parallel with each other and rotational axes 20*b* and 20*d* are in parallel with each other. Accordingly, rotational axes 20*a* and 20*b* as well as rotational axes 20*c* and 20*d* are formed to have a certain V-shaped space therebetween. Wheels 25*a*, 25*b*, 25*c* and 25*d* are provided around rotational axes 20*a*, 20*b*, 20*c* and 20*d*. Around wheels 25*a*, 25*b*, 25*c* and 25*d*, there are provided transport belts 40*a* and 40*b* for conveying turning forces by frictional forces on peripheral surfaces of wheels 25*a* and 25*c* and wheels 25*b* and 25*d*. Transport belts 40*a* and 40*b* have respective sides on pedestal 10 that are provided in parallel and adjacently to each other.

Figure 4:
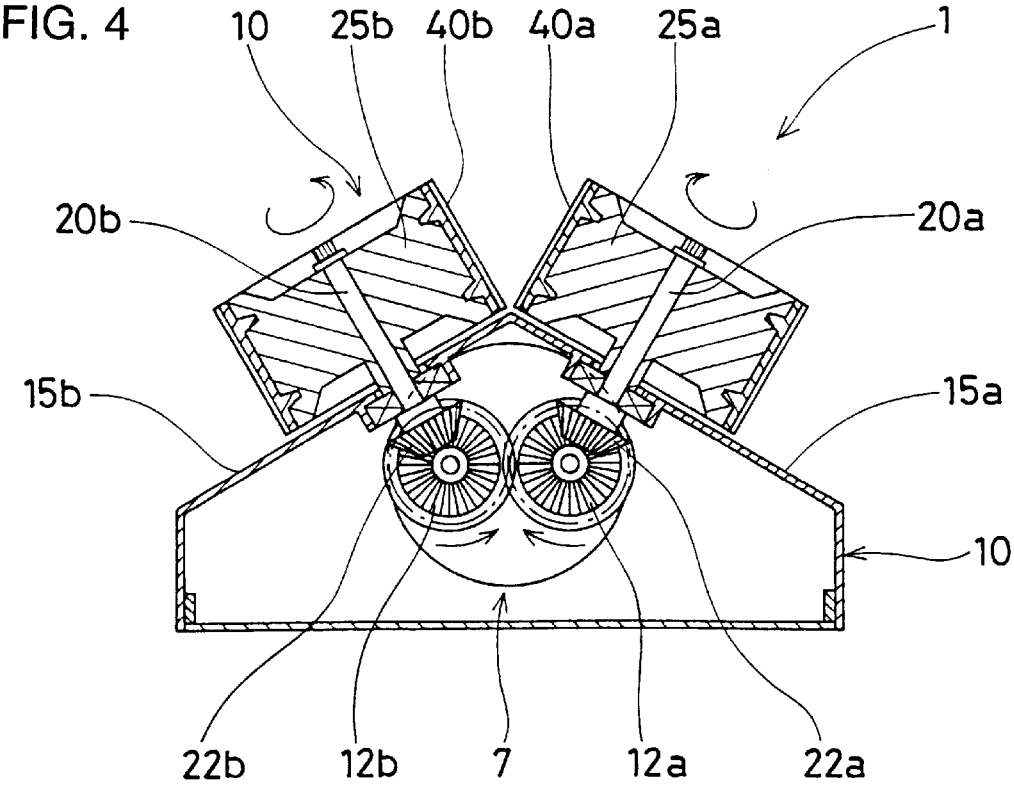
FIG. 4 shows a cross section along A—A of the cross section in FIG. 2 of the object transport apparatus according to the first embodiment of the invention.
Figure 5:
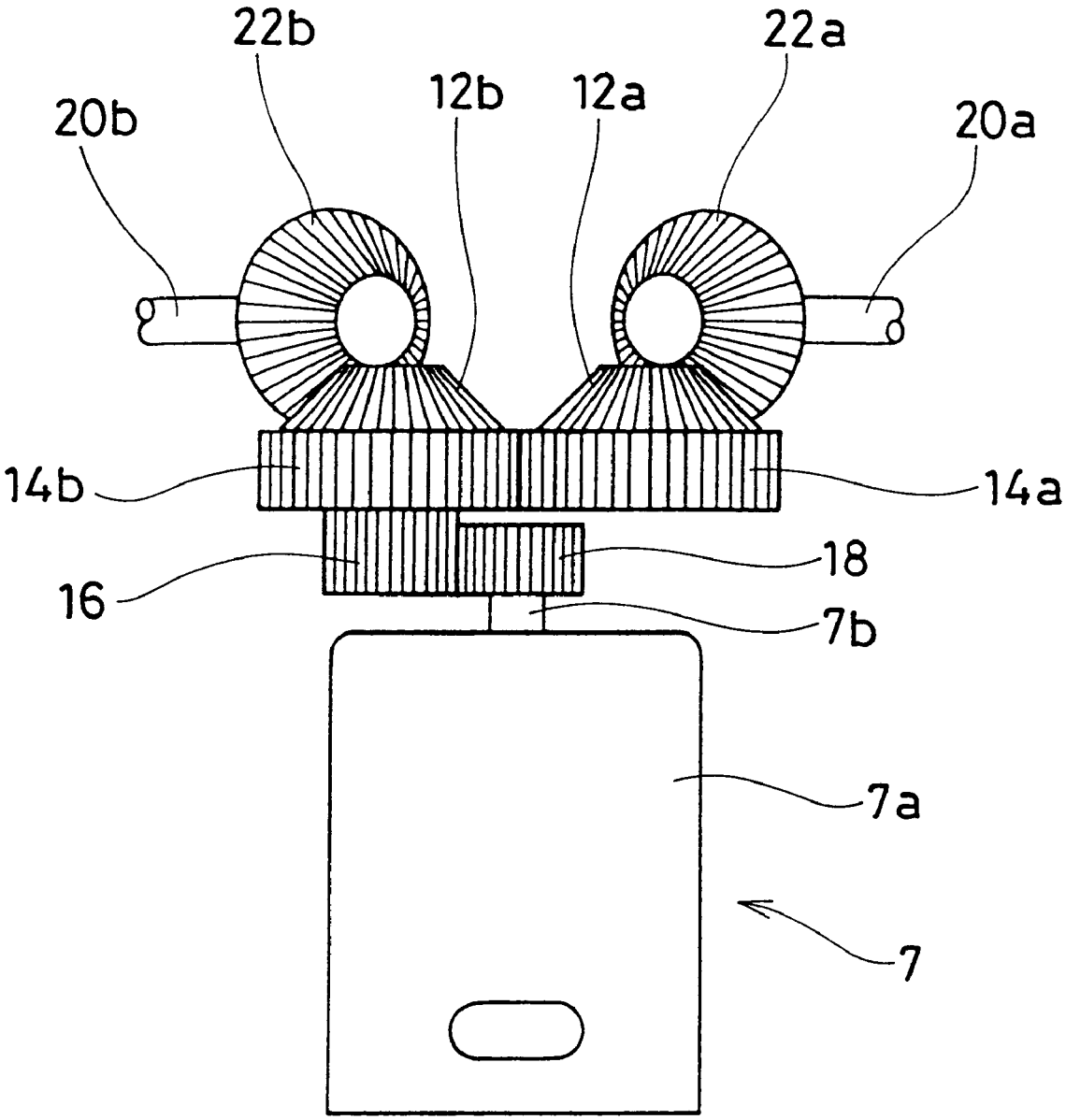
FIG. 5 shows a drive unit from below of the object transport apparatus according to the first embodiment of the invention.

Drive unit 7 includes as shown in FIGS. 4 and 5 a spur gear 18 caused to rotate by a drive force of a motor 7*a* transmitted by a shaft 7*b*, a spur gear 16 engaging with spur gear 18, a spur gear 14*b* and a bevel gear 12*b* provided on one shaft to share the rotational axis with spur gear 16, a bevel gear 22*b* engaging with bevel gear 12*b*, a spur gear 14*a* engaging with spur gear 14*b*, a bevel gear 12*a* provided on one shaft to share the rotational axis with spur gear 14*a*, and a bevel gear 22*a* engaging with bevel gear 12*a*. Respective inclined parts of bevel gears 12*a*, 12*b*, 22*a* and 22*b* each form an angle of 45° with respect to the rotational axis, so that shaft 7*b* of motor 7*a* as well as respective rotational axes of spur gears 14*a* and 14*b* and bevel gears 12*a* and 12*b* cross at right angles the plane formed by rotational axes 20*a* and 20*b*.

Figure 1:
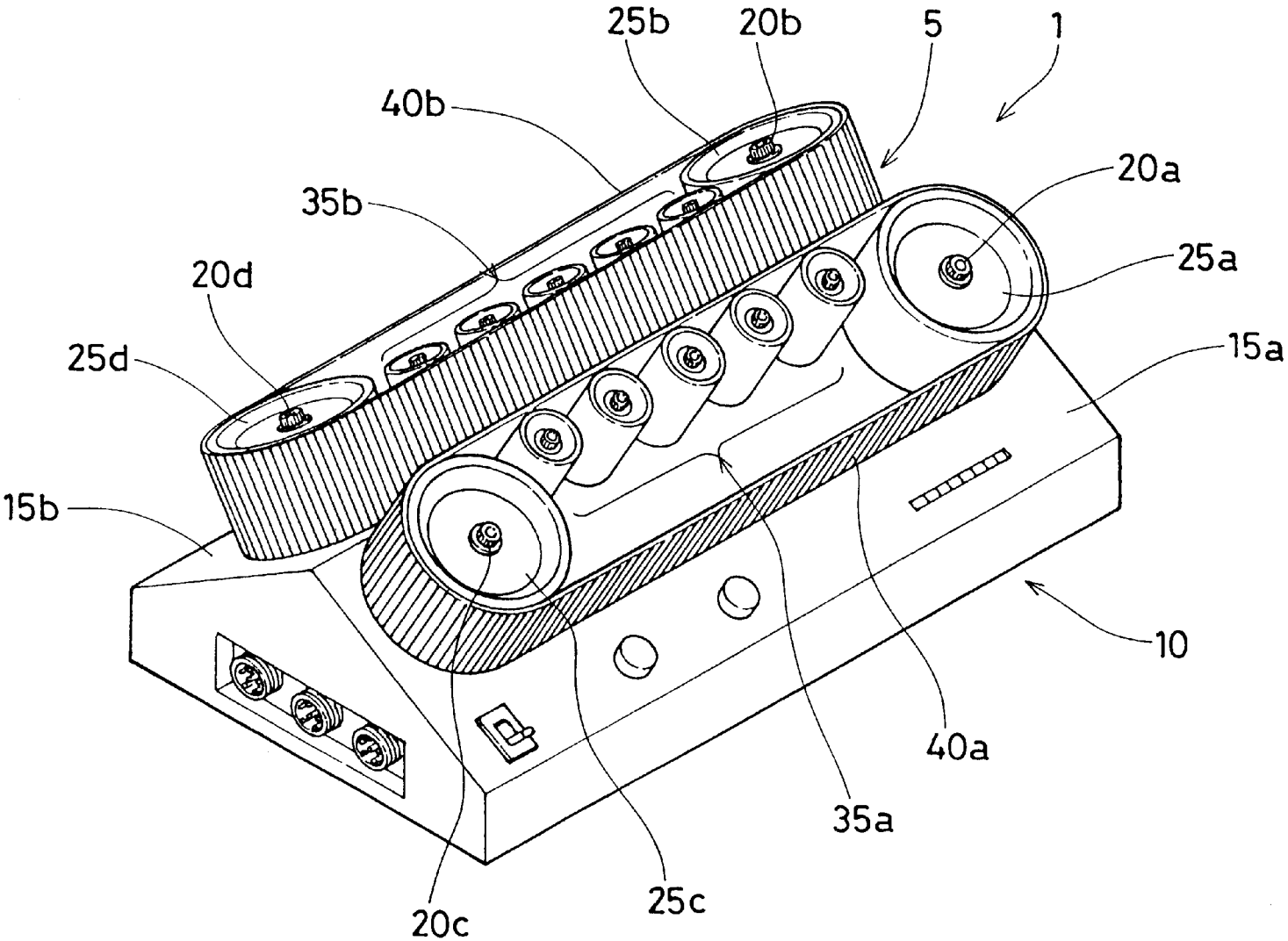
FIG. 1 is a perspective view of an object transport apparatus according to a first embodiment of the present invention.
Figure 2:
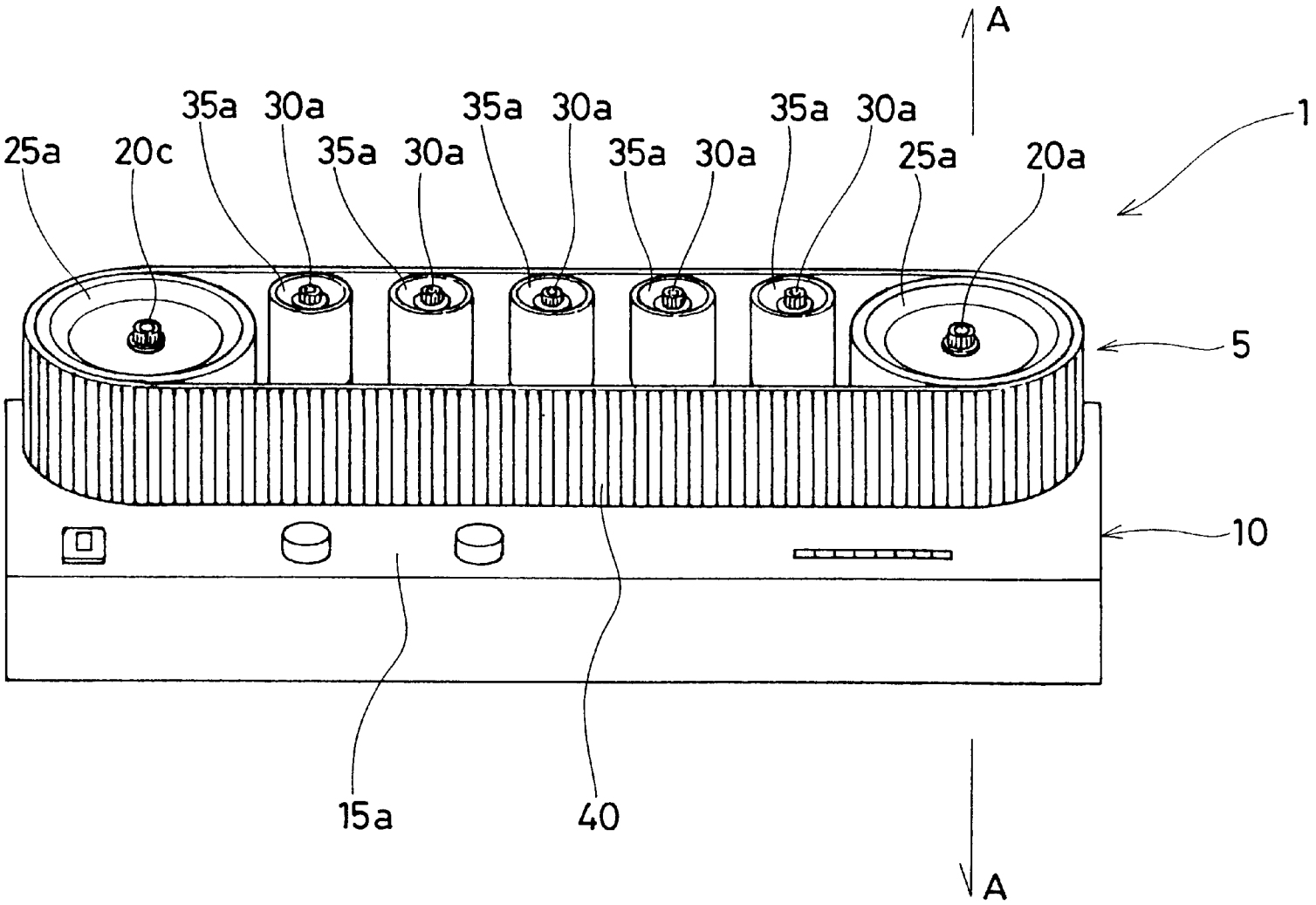
FIG. 2 is a side view of the object transport apparatus according to the first embodiment of the invention.
Figure 3:
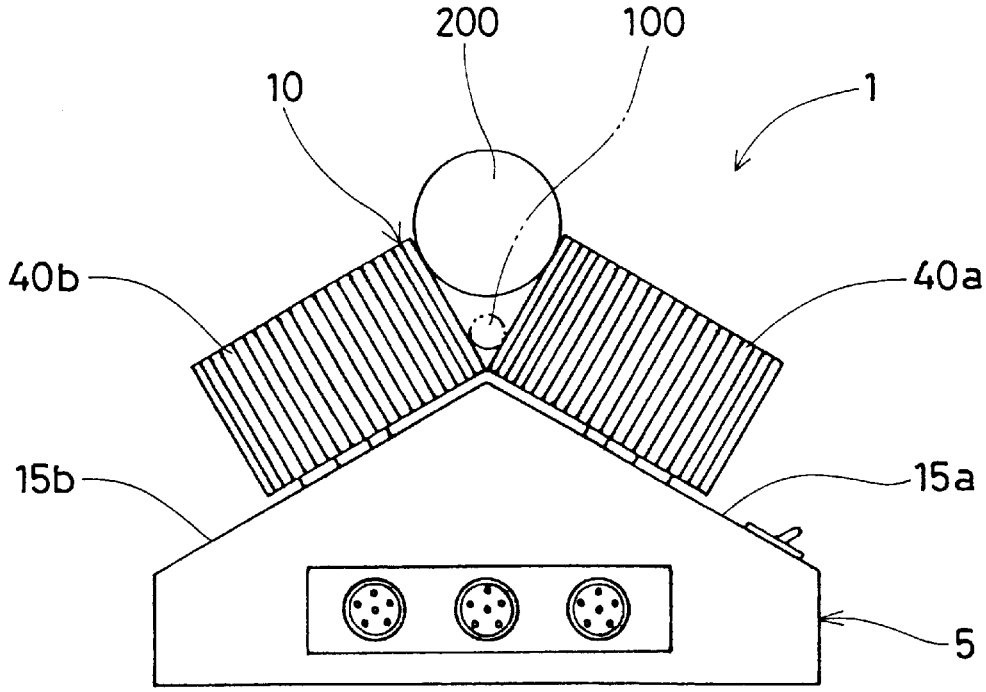
FIG. 3 is a front view of the object transport apparatus according to the first embodiment of the invention.

In use of object transport apparatus 1, a turning force of motor 7*a* constituting drive unit 7 shown in FIG. 5 is transmitted via shaft 7*b* to spur gear 18, and spur gear 16 then rotates in the direction opposite to the rotational direction of spur gear 18. Accordingly, spur gear 14*b* and bevel gear 12*b* fastened to spur gear 16 with the common shaft rotate in the same direction as the rotational direction of spur gear 16. Bevel gear 22*b* and spur gear 14*a* thus rotate. Further, bevel gear 12*a* sharing the rotational axis with spur gear 14*a* rotates in the same direction as the rotational direction of spur gear 14*a*, which causes bevel gear 22*a* to rotate. Bevel gear 22*a* and bevel gear 22*b* accordingly rotate about respective rotational axes 20*a* and 20*b* in the opposite directions respectively. In this way, turning forces of rotational axes 20*a* and 20*b* are conveyed to wheels 25*a* and 25*b* and then turning forces of wheels 25*a* and 25*b* are conveyed by frictional force to transport belts 40*a* and 40*b*, so that cable 200 is fed in the transport direction as shown in FIG. 3. At this time, wheel 25*c* rotates identically in direction with wheel 25*a*, and wheel 25*d* rotates identically in direction with wheel 25*b* to assist transport belts 40*a* and 40*b* to circulate. In addition, a plurality of auxiliary wheels 35 are provided with respective rotational axes in parallel for preventing transport belts 40*a* and 40*b* from becoming loose, and rotate according to circulation of transport belts 40*a* and 40*b*.

In this object transport apparatus 1, rotational axes 20*a* and 20*c* and rotational axes 20*b* and 20*d* are not in parallel but provided to cross each other so that the space formed between transport belts 40*a* and 40*b* has the V-shape. In this V-shaped space, as shown in FIG. 3, thin cable 100 is transported being fit in the lower part of the space while thick cable 200 is transported being fit in the upper part thereof. Even if both of thin cable 100 and thick cable 200 are to be used successively, it is possible to transport the cables by this object transport apparatus 1 only without employing another object transport apparatus nor another mechanism.

The V-shaped space between transport belts 40*a* and 40*b* allows both of thin cable 100 and thick cable 200 to be fed without shifting upward or downward owing to the action of gravity which exerts only a downwardly pulling force thereon. Auxiliary wheels 35 provided to prevent loosening of transport belts 40*a* and 40*b* allow the area of contact as well as components of force of contact between transport belts 40*a* and 40*b* and a cable to approximately be constant. Cables 100 and 200 having different diameters can thus be fed successively without escaping from object transport apparatus 1 and without lowering the feeding rate.

Figure 6:
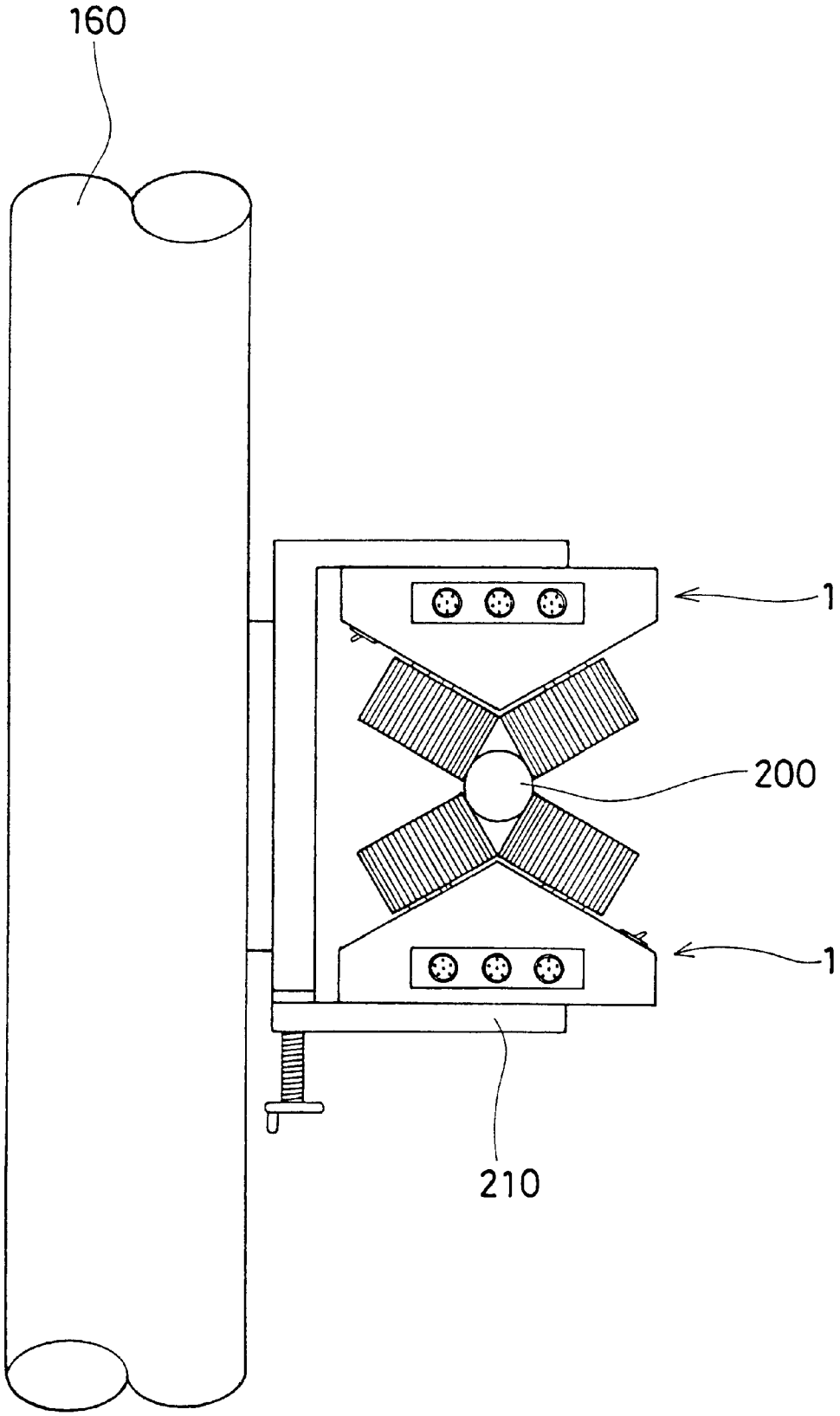
FIG. 6 shows one example of the state in which the object transport apparatus is used according to the first embodiment of the invention.

If the cable is thick, object transport apparatuses 1 can be used as shown in FIG. 6 to hold cable 200 therebetween from the top and bottom so as to transport the cable in more stable manner.

Regarding drive unit 7 of object transport apparatus according to this embodiment, bevel gears 22*a* and 22*b* can have respective rotational axes 20*a* and 20*b* crossing with a predetermined angle therebetween in a plane perpendicular to the rotational axes of spur gears 14*a*, 14*b*, 16 and 18 and bevel gears 12*a* and 12*b*. In this way, the V-shaped space can be formed between wheels 25*a* and 25*b* provided on respective rotational axes 20*a* and 20*b* of bevel gears 22*a* and 22*b*. Successive use of the apparatus is thus possible without adjusting positions of rotational axes 20*a*, 20*b*, 20*c* and 20*d* even if the diameter of cables considerably changes.

Second Embodiment

A second embodiment of the present invention is now described in conjunction with FIGS. 7–12. An object transport apparatus 2 according to this embodiment includes a cable support unit 8 in addition to components of object transport apparatus 1 shown in FIGS. 1–5. Object transport apparatus 2 includes a stationary section 59 provided on a surface 15*a* of a pedestal 10. A stationary section 56 is further provided on a surface 15*b* of pedestal 10. A movable section 57 is provided on the leading end of stationary section 56 such that movable section 57 can turn on an axis of turn 58. A press wheel 55 for pressing a cable from the above is provided to rotate around a rotational axis 54, and rotational axis 54 is detachably supported by supporting section 53. An external thread 52 is provided on the upper portion of supporting section 53 for moving supporting section 53 downward, and this external thread 52 passing through an internal thread provided in movable section 57 has a manual rotate section 51 on its end.

Figure 7:
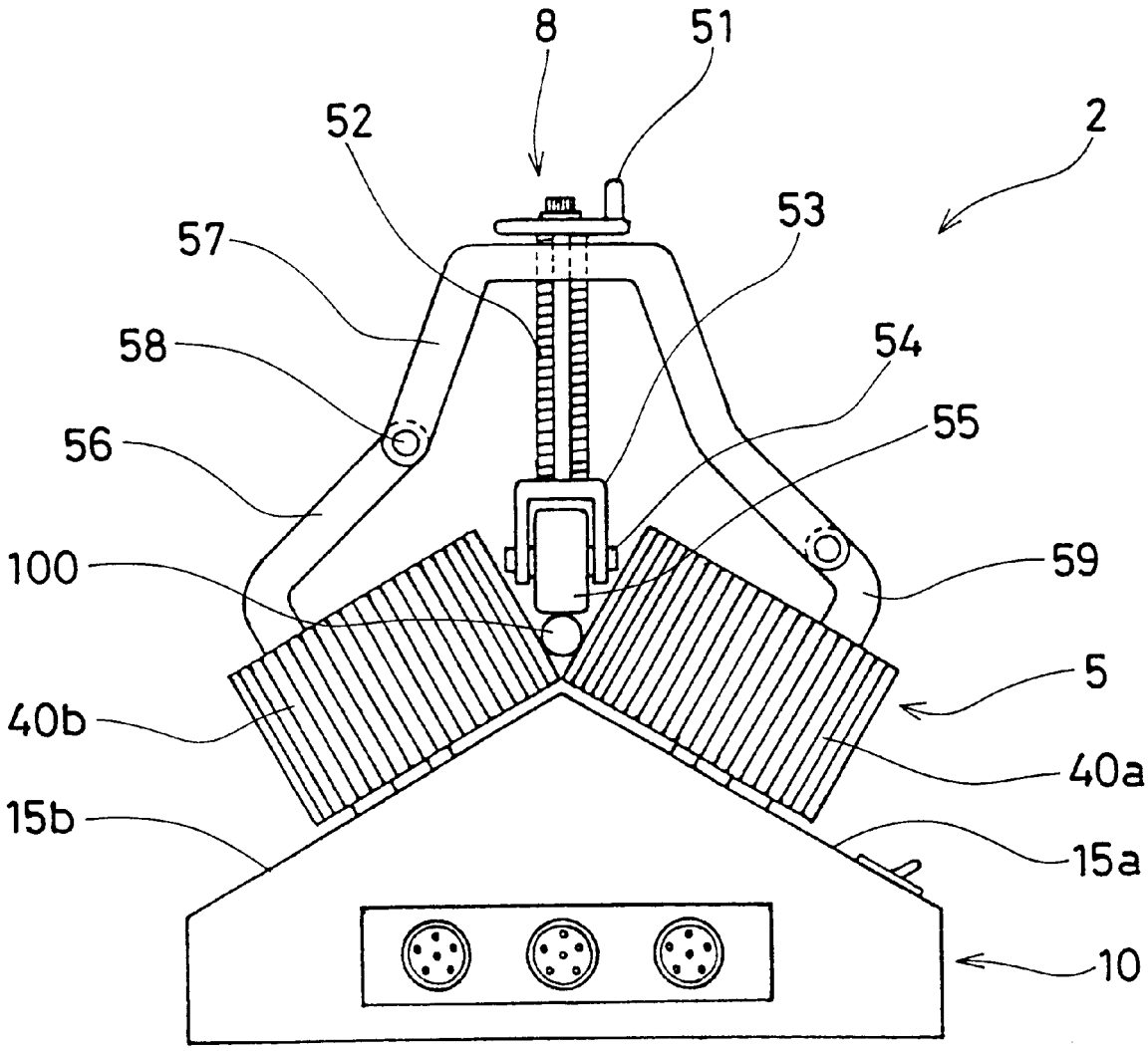
FIG. 7 is a front view of an object transport apparatus transporting a small-diameter cable according to a second embodiment of the invention.
Figure 8:
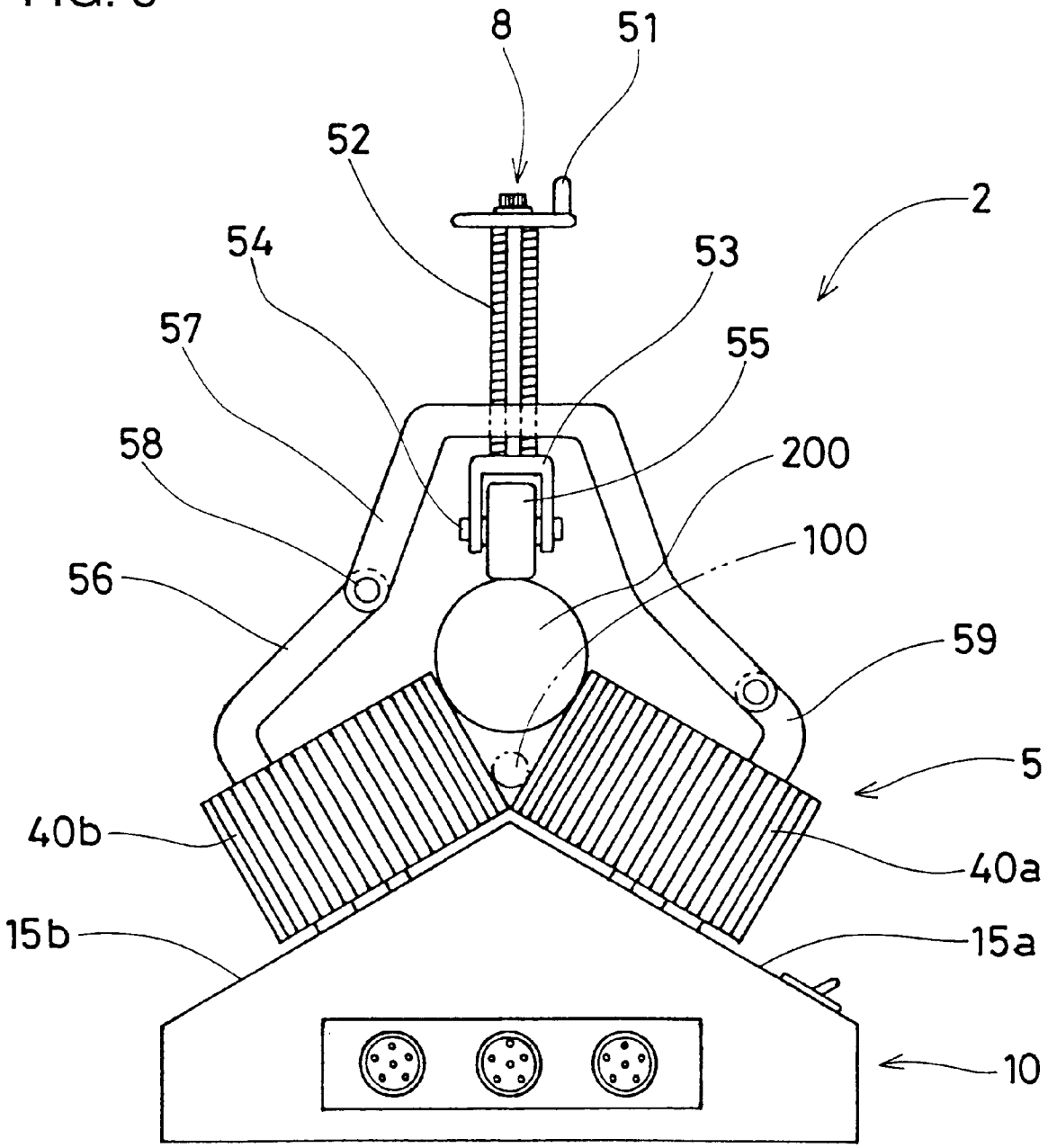
FIG. 8 is a front view of the object transport apparatus transporting a large-diameter cable according to the second embodiment of the invention.

When object transport apparatus 2 is used, manual rotate section 51 is rotated to screw external thread 52 downward, and accordingly press wheel 55 moves downward to press the cable. For a thin cable 100, as shown in FIG. 7, manual rotate section 51 is rotated a greater number of times to shift press wheel 55 downward by a longer distance in order to press thin cable 100. For a thick cable 200, as shown in FIG. 8, manual rotate section 51 is rotated a smaller number of times to shift press wheel 55 by a shorter distance to press thick cable 200. Regardless of the diameter of the cable, i.e., for both of thin cable 100 and thick cable 200, the cable can be pressed with a constant pressure. It is thus possible to avoid decrease in transport speed and upward and downward deviation of a cable which is being transported.

Figure 9:
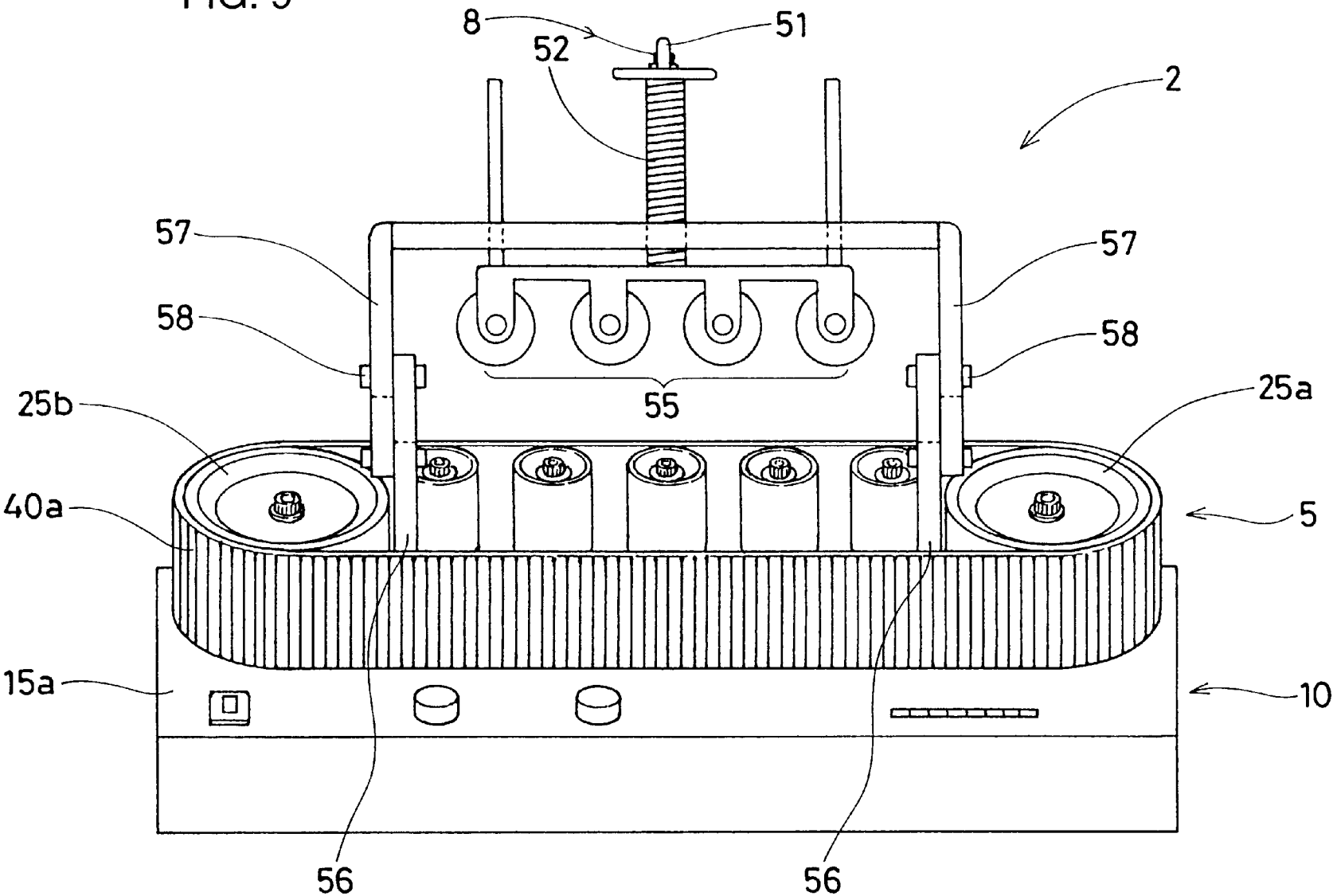
FIG. 9 is a side view of the object transport apparatus according to the second embodiment of the invention.
Figure 10:
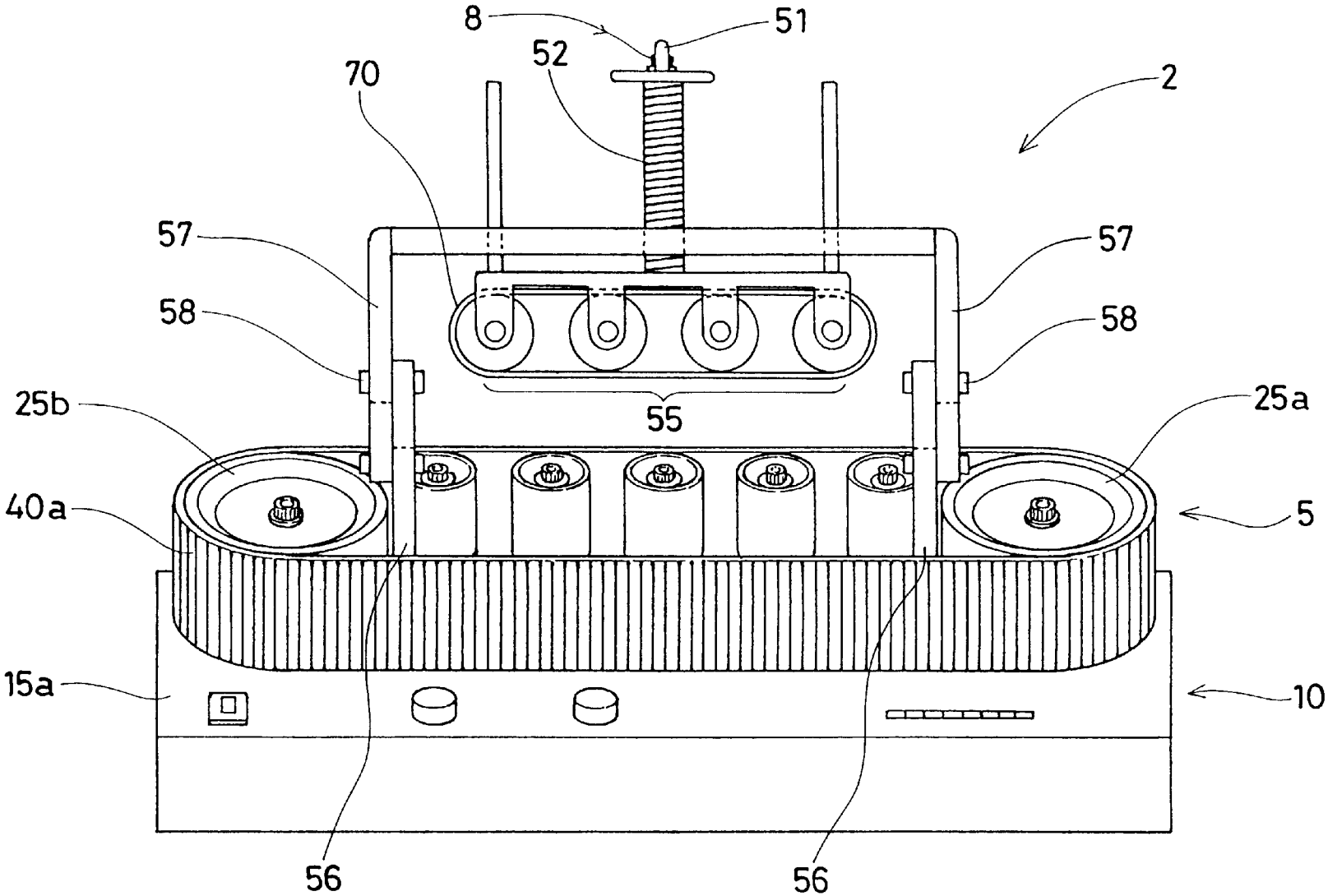
FIG. 10 is a side view of the object transport apparatus having a transport belt around a cable support unit according to the second embodiment of the invention.
Figure 11:
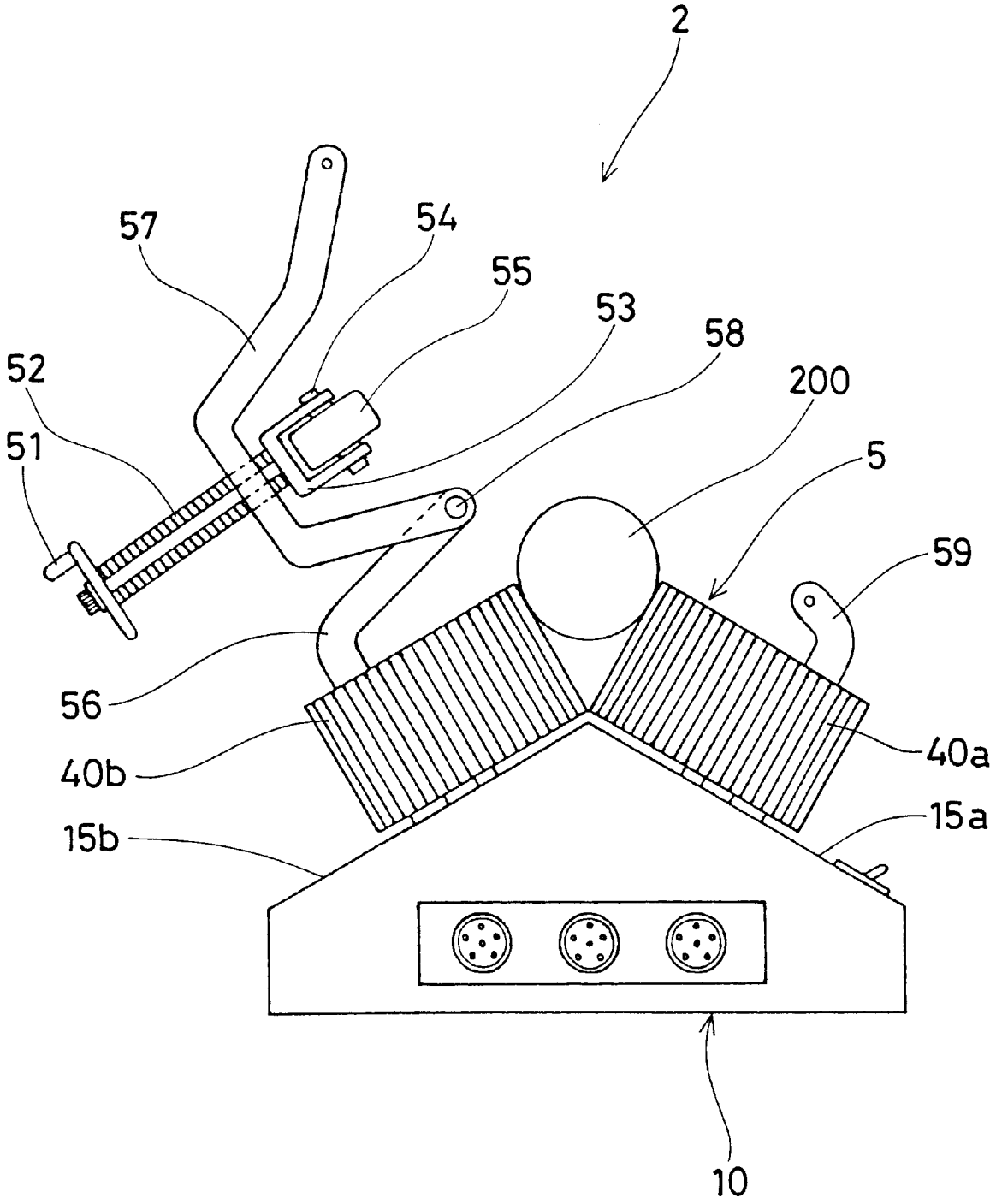
FIG. 11 is a front view of the object transport apparatus having the support unit for pressing a cable, the support unit being opened for removing the cable according to the second embodiment of the invention.

The cable can more stably be pressed by providing a plurality of press wheels 55 in cable support unit 8 as shown in FIG. 9. A transport belt 70 can further be used as shown in FIG. 10 that moves with transport of a cable while being wound around press wheels 55 or in contact therewith to stabilize the pressure on the cable. In addition, this cable support unit 8 facilitates attachment and detachment of a cable as shown in FIG. 11 by turning movable section 57 about turn axis 58 away from the cable.

Figure 12:
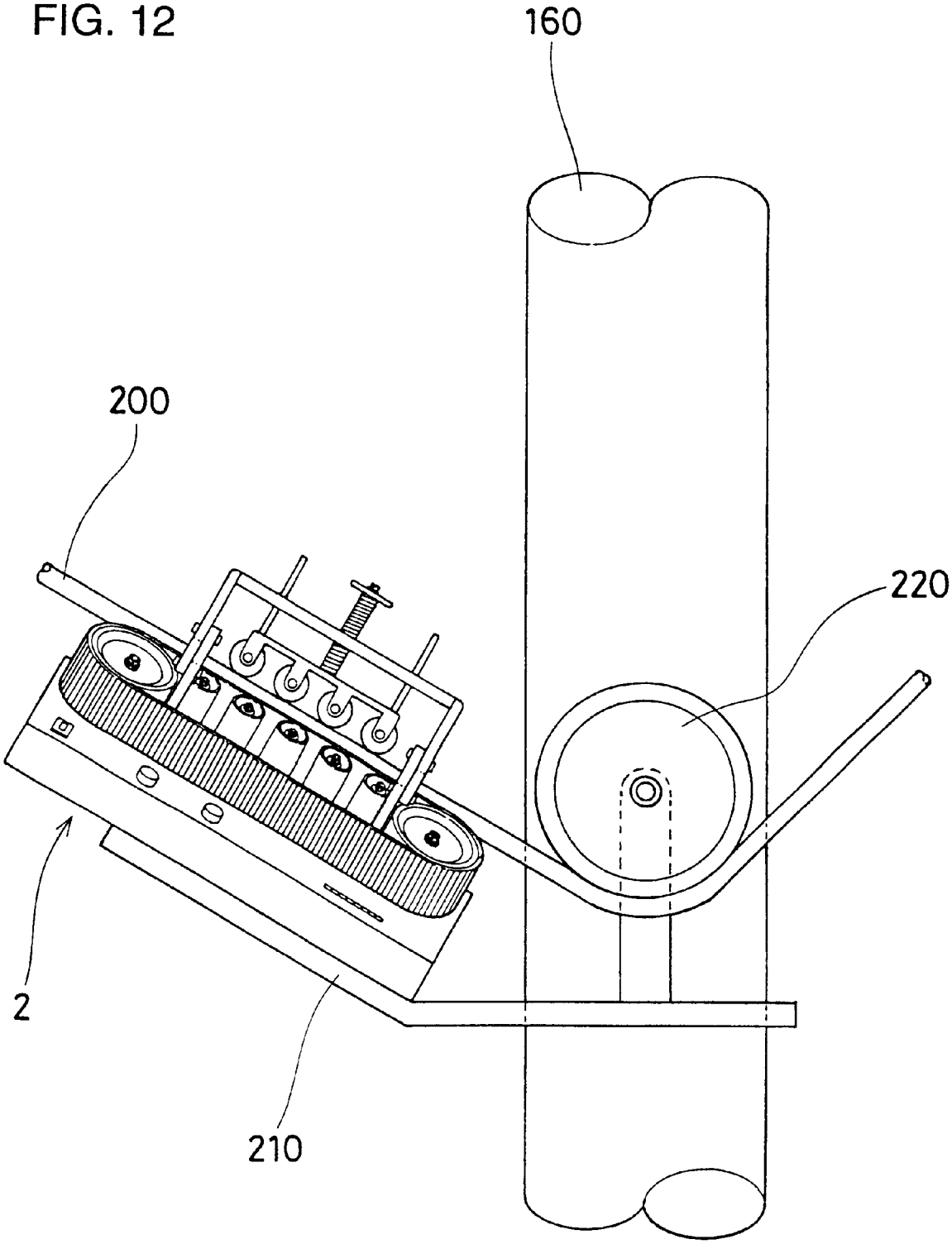
FIG. 12 shows the second embodiment secured in use to a pole according to the second embodiment of the invention.
Figure 23:
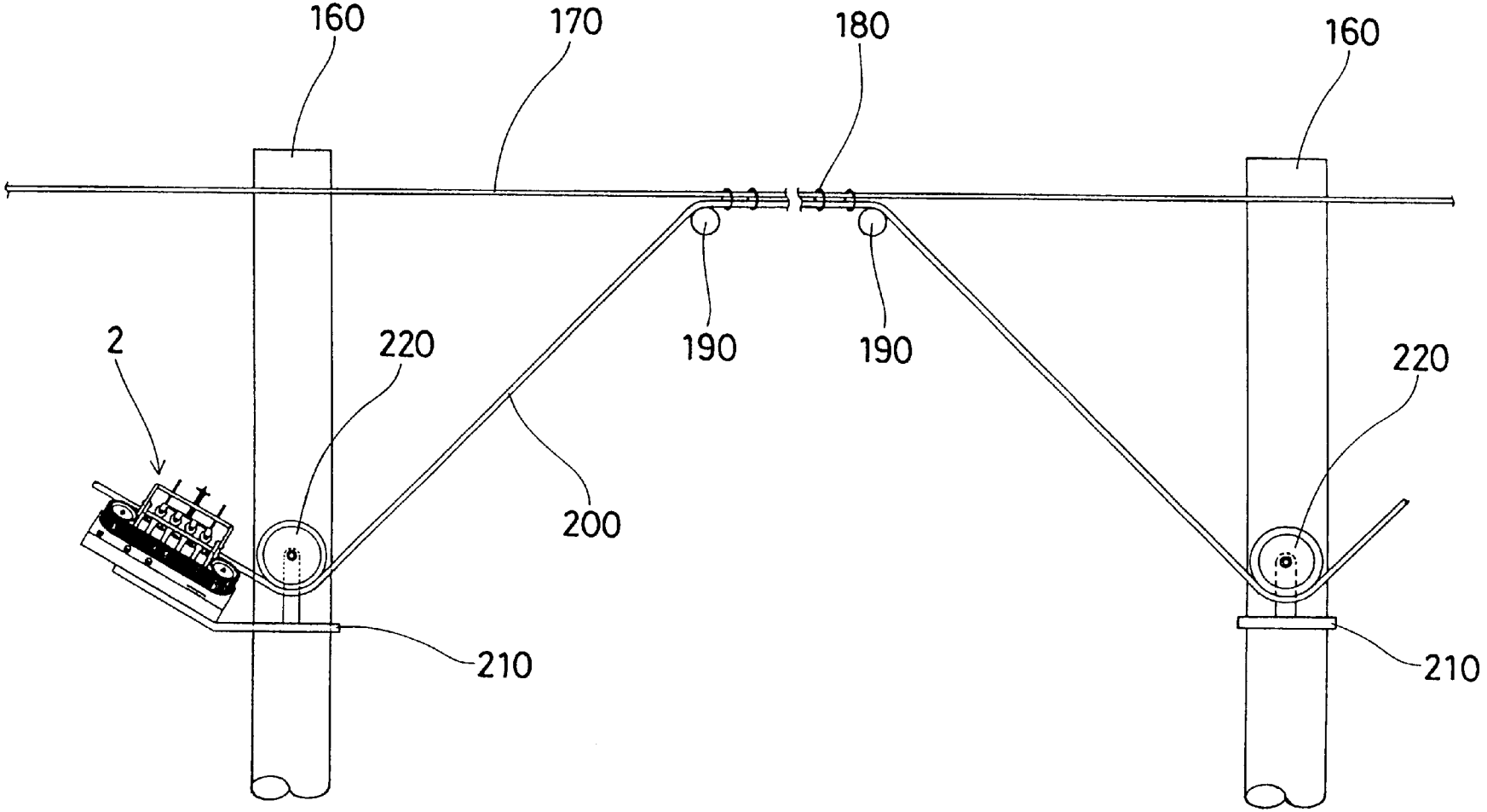
FIG. 23 shows the object transport apparatuses according to the second embodiment for explaining a conventional method of using the apparatus being provided on a pole.
Figure 24:
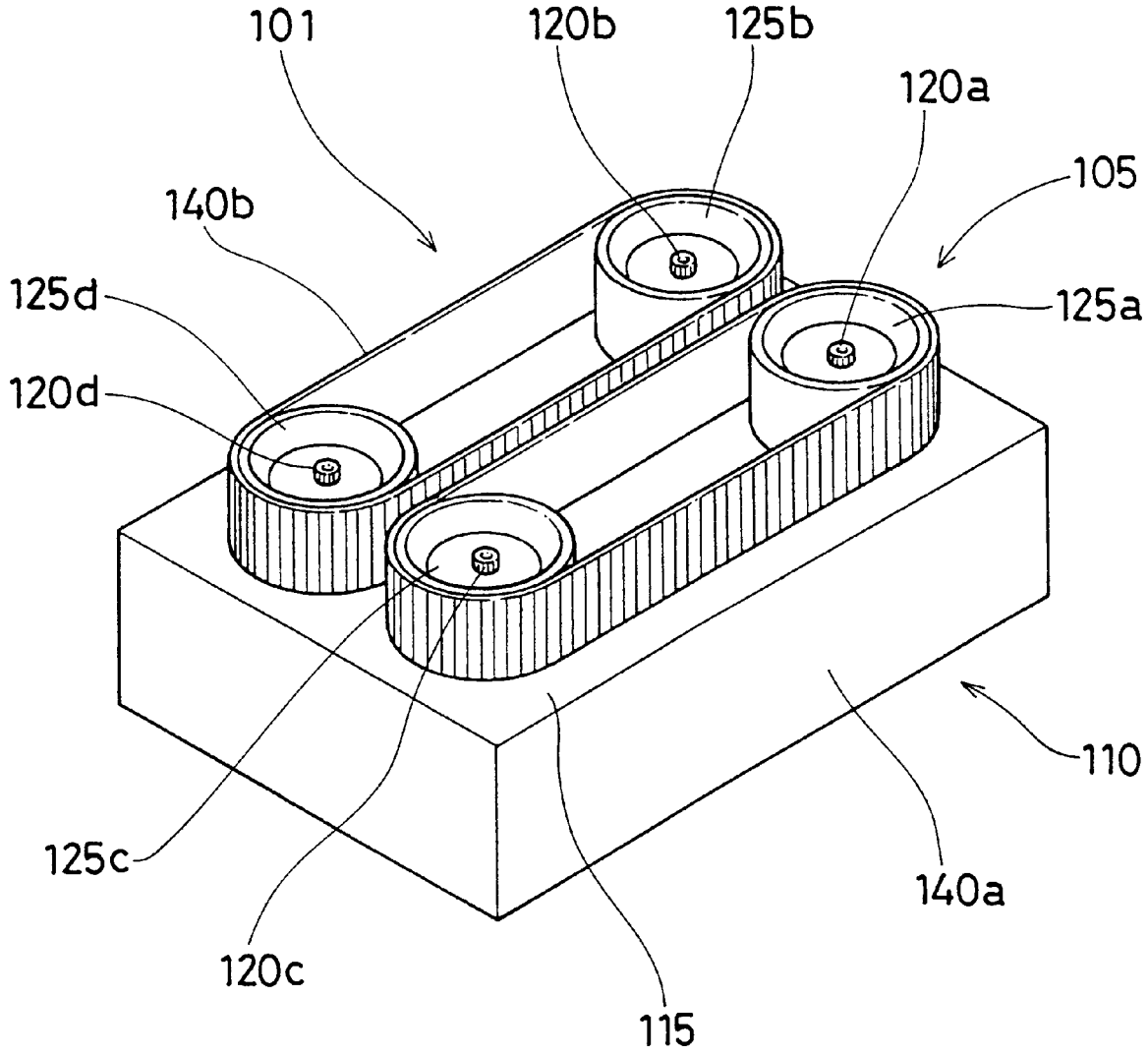
FIG. 24 PRIOR ART
FIG. 24 is a perspective view of a conventional object transport apparatus.
Figure 25:
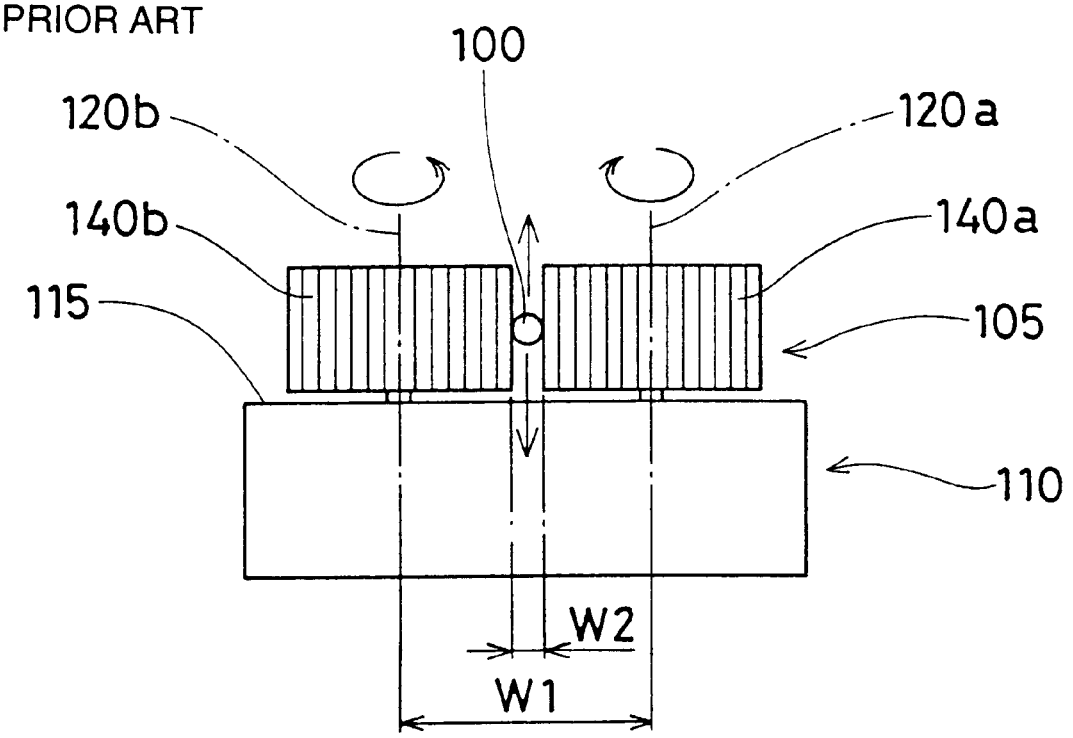
FIG. 25 PRIOR ART
FIG. 25 is a front view of the conventional object transport apparatus.
Figure 26:
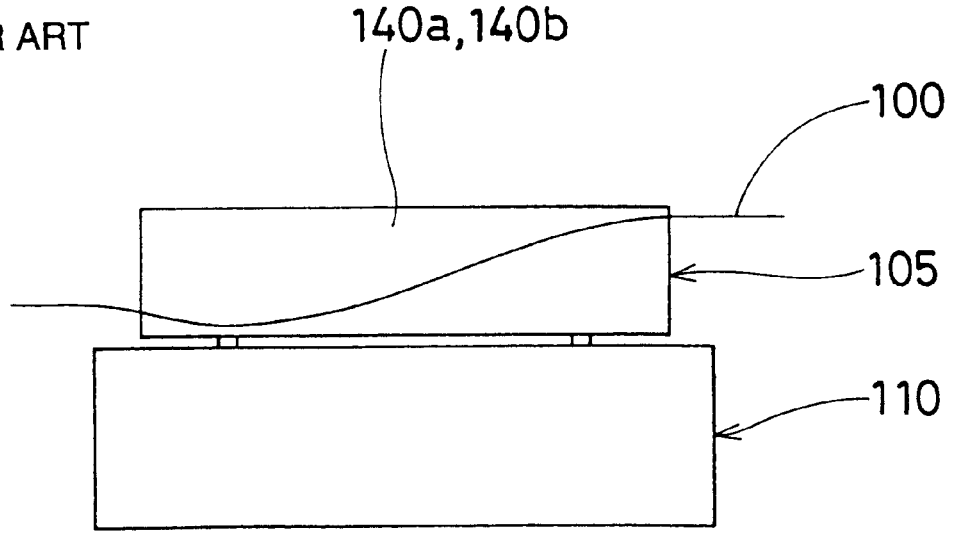
FIG. 26 PRIOR ART
FIG. 26 shows an operation of a cable in transport belts of the conventional object transport apparatus.
Figure 27:
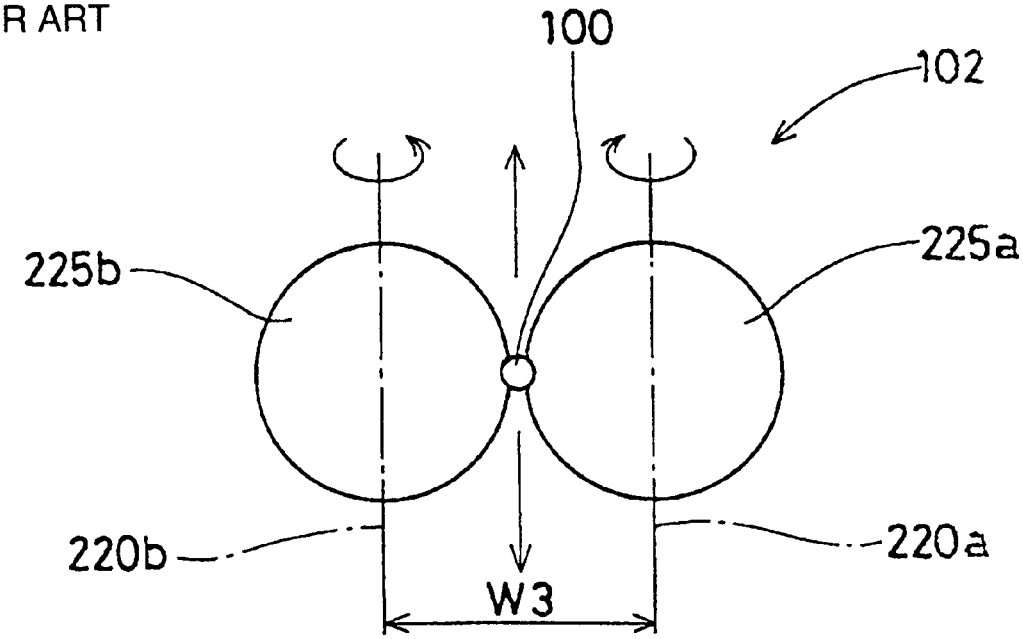
FIG. 27 PRIOR ART
FIG. 27 shows another conventional object transport apparatus for explaining the state in which spherical wheels transport a thin cable.
Figure 28:
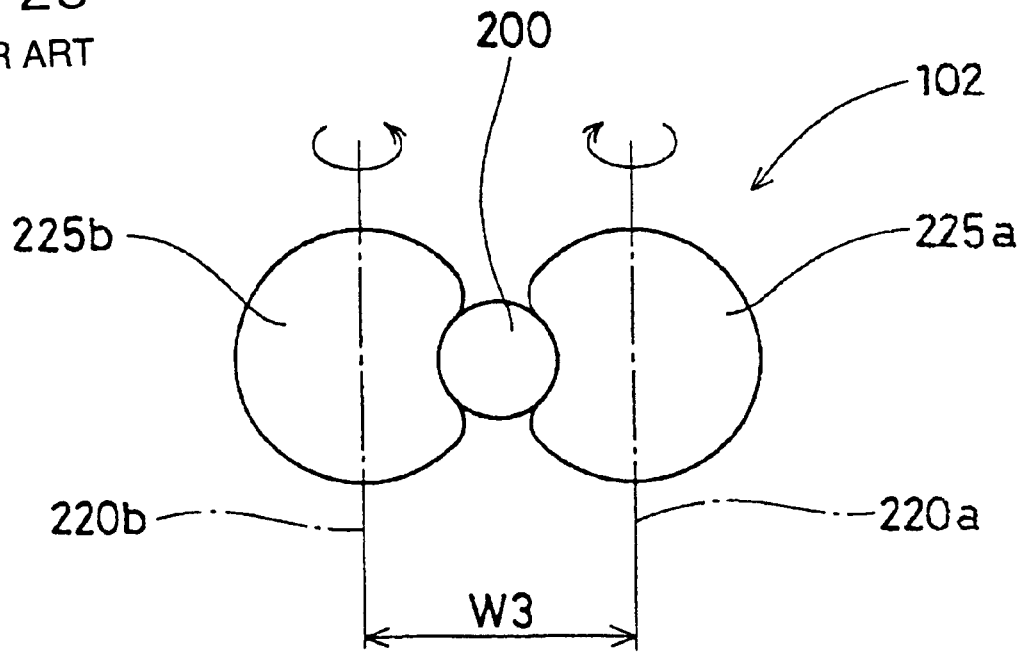
FIG. 28 PRIOR ART
FIG. 28 shows the another conventional object transport apparatus for explaining the state in which spherical wheels transport a thick cable.

Object transport apparatus 2 of the second embodiment is secured to a pole as shown in FIG. 12 by mounting object transport unit 2 on a support platform 210 that is fixed on a pole 160. Pulleys 190 and 220 are used for preventing a cable from excessively bending. Object transport apparatus 2 is used in the state as shown in FIG. 23.

Although a cable is exemplarily used as the object being transported by object transport apparatus 2 according to this embodiment, the same effect achieved for the cable discussed above can-be obtained for other signal lines such as optical fiber cable and the like. In particular, for the optical fiber cable having a smaller tensile strength, deviation of the optical fiber cable cannot be prevented by forcibly exerting a tensile force on the cable. Object transport apparatus 2 of the present invention can then be used to transport the optical fiber cable without the need to avoid deviation of the cable by applying a tensile force thereto, and thus there is less possibility of breaking the optical fiber cable.

Object transport apparatus 2 according to this embodiment can also be used for transporting an object having a fixed diameter such as inflexible steel pipe, tube, timber and the like or an object having a substantially constant cross section such as square timber, square pipe and the like.

Third Embodiment

Figure 13:
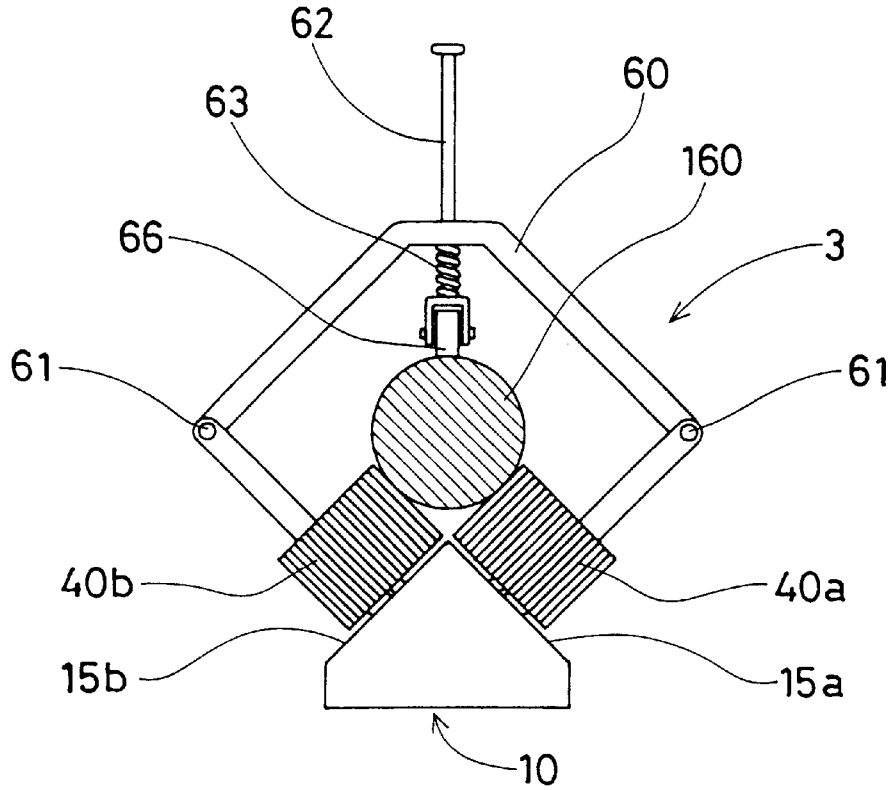
FIG. 13 shows an object transport apparatus according to a third embodiment of the invention for explaining a method of using the apparatus by securing the apparatus to a large-diameter pole, the apparatus being viewed in a cross section of the pole.
Figure 14:
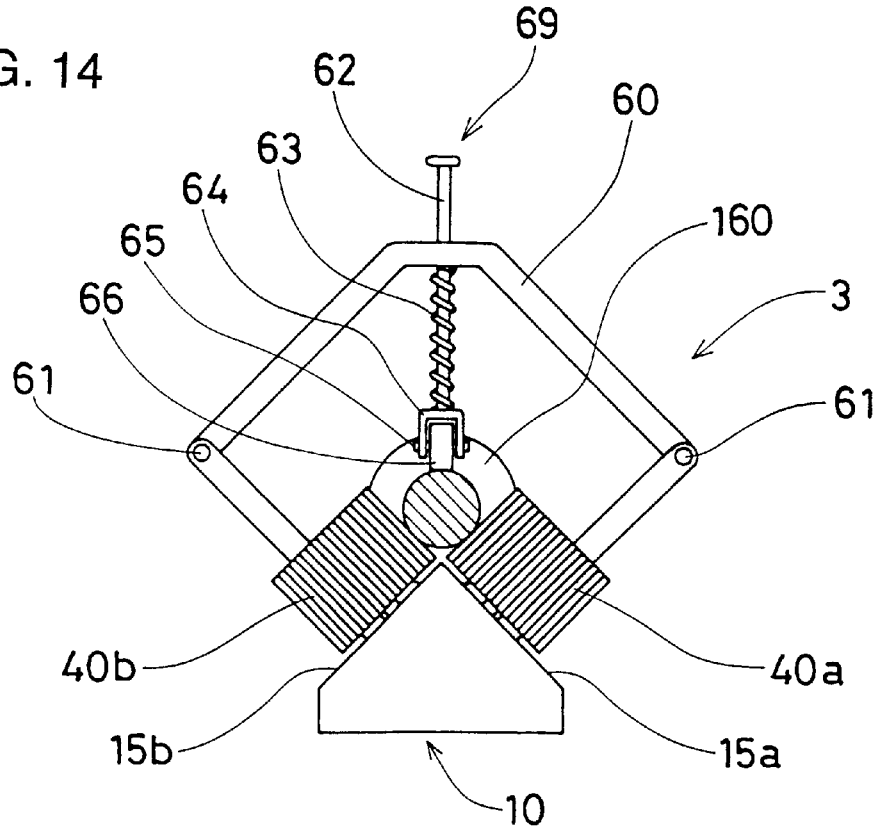
FIG. 14 shows the object transport apparatus according to the third embodiment of the invention for explaining a method of using the apparatus by securing the apparatus to a small-diameter pole, the apparatus being viewed in a cross section of the pole.
Figure 15:
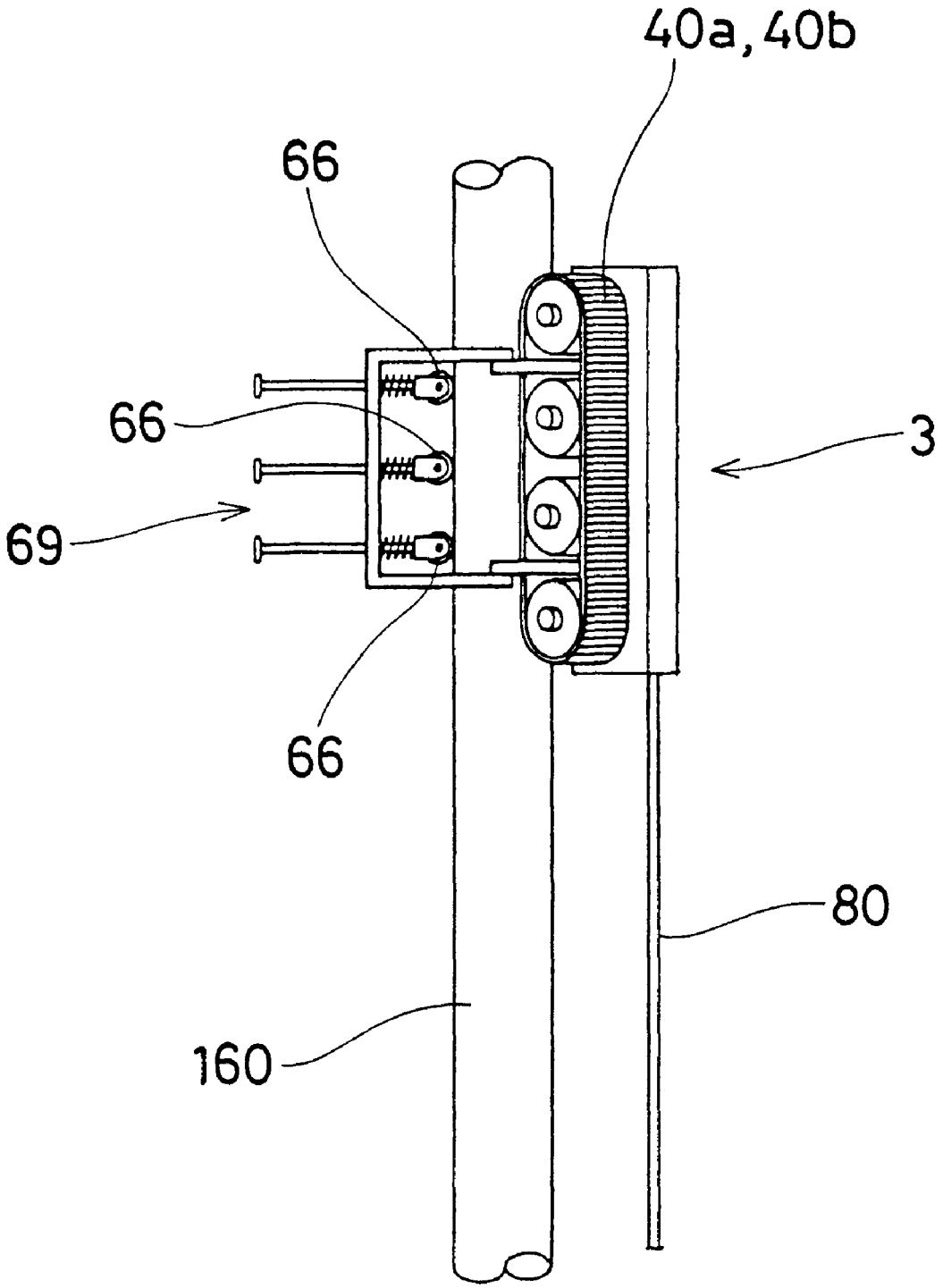
FIG. 15 shows the object transport apparatus according to the third embodiment for explaining a method of using the apparatus, the apparatus climbing up a pole while pulling a safety rope.

A third embodiment of the present invention is now described in conjunction with FIGS. 13 and 14. An object transport apparatus 3 of the third embodiment further includes a press section 69 as shown in FIGS. 13 and 14 in addition to the components of object transport apparatus 1 of the first embodiment for allowing the apparatus to move up and down with a pole 160 being caught therein and pressed. This press unit 69 has a sheet-like arm 60 with respective ends provided on surfaces 15*a* and 15*b* respectively of a pedestal 10. Arm 60 has a mechanism to bend at axes of turn 61 each located at a predetermined distance from the point at which arm 60 is fixed on surface 15*a* or 15*b* as if arm 60 is pressed down toward pedestal 10. Arm 60 has a spring 63 for pushing a wheel 66 toward pedestal 10 so as to press pole 160 at three points. Spring 63 thus presses supporting section 64 toward pedestal 10. A rotational axis 65 is then pressed toward pedestal 10 and accordingly press wheel 66 presses an object. When object transport apparatus 3 is used, as shown in FIG. 15, transport belts 40*a* and 40*b* forming the V-shape and press wheel 66 are brought into contact with pole 160 and frictional forces between transfer belts 40*a* and 40*b* and press wheel 66 and pole 160 cause object transport apparatus 3 to climb along pole 160 standing upright.

Figure 16:
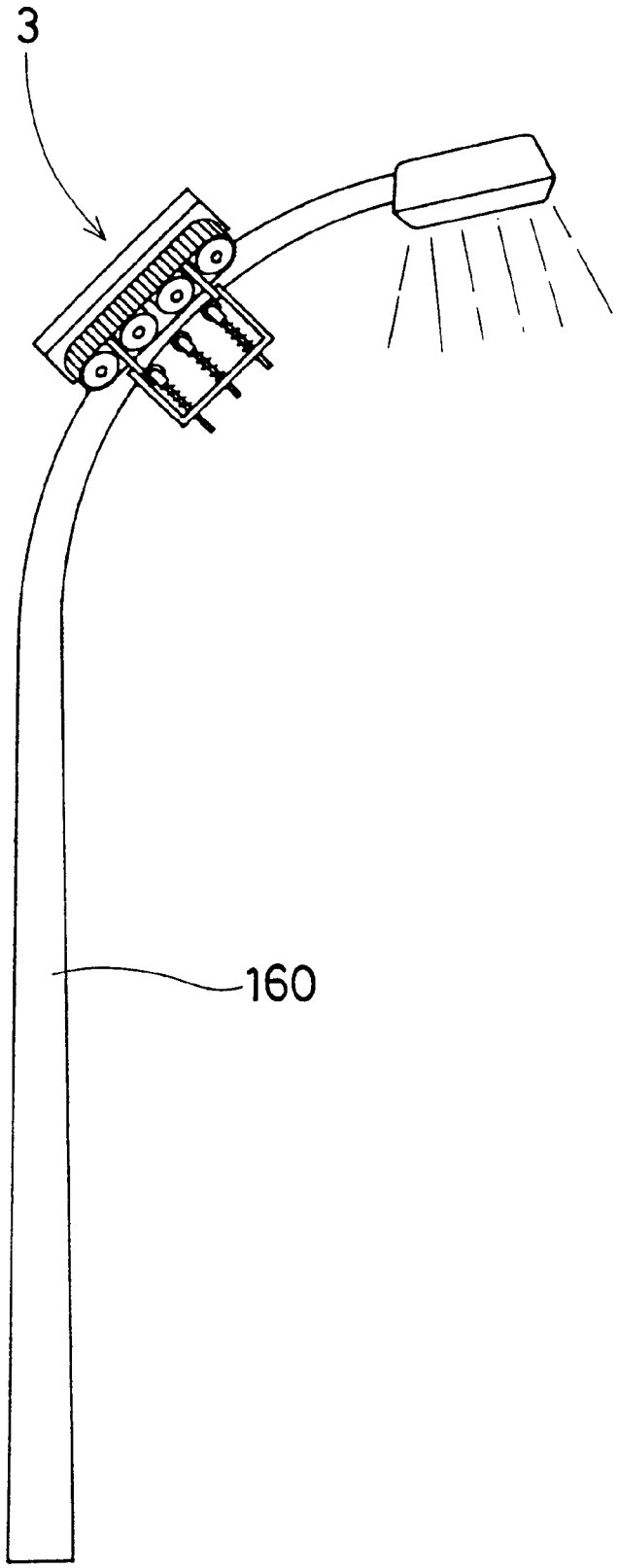
FIG. 16 shows the object transport apparatus according to the third embodiment for explaining a method of using the apparatus, the apparatus climbing up a pole having its diameter decreasing toward its head.

By employing such a method as explained above of using object transport apparatus 3 of this embodiment, an electric cable, rope and the like can be transported to the head of pole 160 without human power. If the pressing force of spring 63 is sufficiently great, the object transport apparatus can climb up pole 160 as shown in FIG. 16 while pushing hard against pole 160 even to the top part of pole 160 where the diameter is smaller. At this time, pole 160 is caught by extension of spring 63 according to the diameter of pole 160 through the states from the one shown in FIG. 13 to the one in FIG. 4.

It has been required for a work person to climb up a pole to fix a safety rope to a support unit. On the other hand, object transport apparatus 3 can be used according to the method explained above in installation of an overhead cable on pole 160 for fixing a safety rope 80 as shown in FIG. 15 to the head of pole 160.

Figure 17:
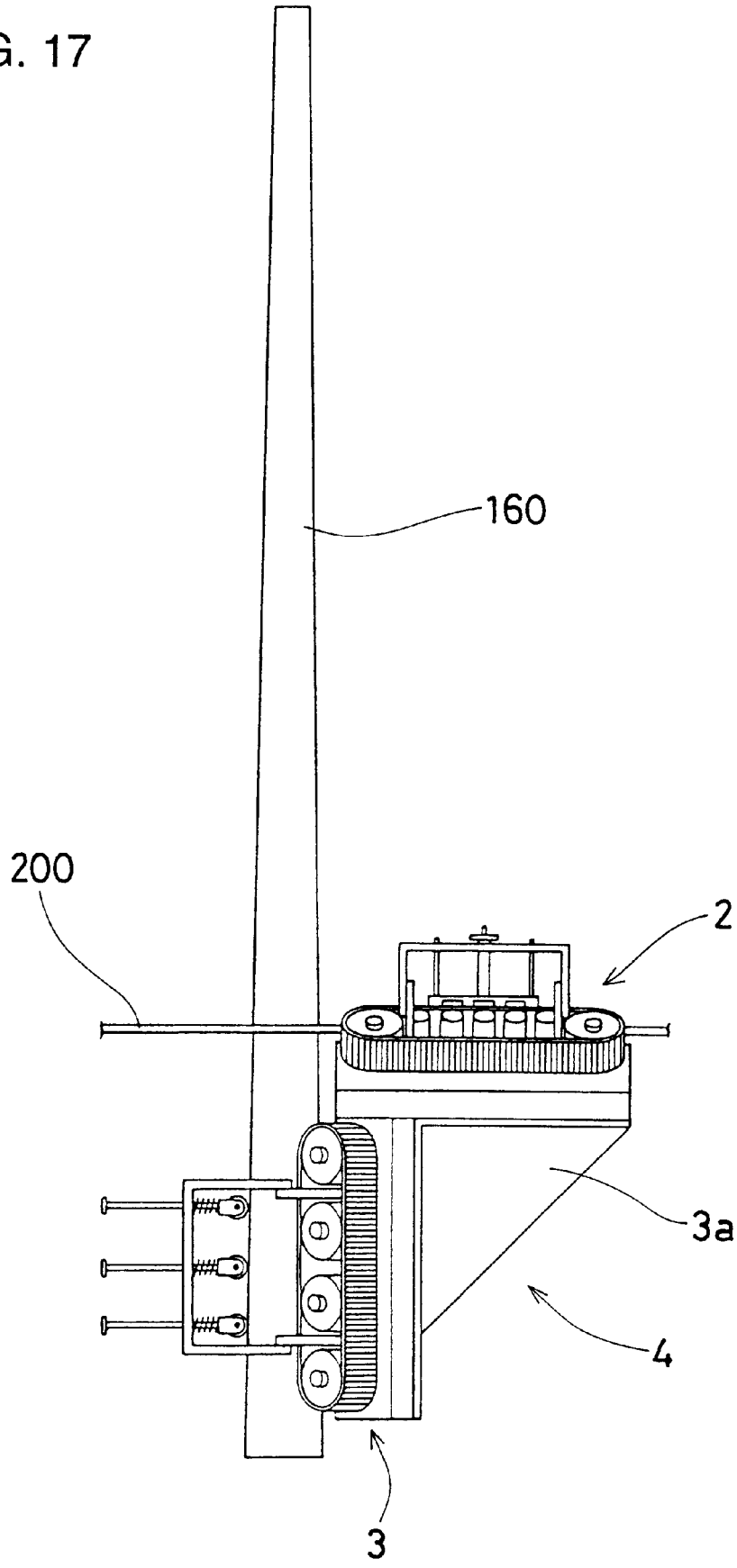
FIG. 17 shows the object transport apparatus according to the third embodiment for explaining a method of using the apparatus, the apparatus climbing up along a pole while holding a cable perpendicularly to the pole.

Alternatively, two object transport apparatuses can be used as shown in FIG. 17. Specifically, an object transport system 4 is constituted of one object transport apparatus 3 moving up and down along pole 160 and the other object transport apparatus 2 fixed perpendicularly to pole 160, with a triangular plate 3*a* therebetween. A cable is conveyed to the upper part of pole 160 and thereafter transported in a direction perpendicular to pole 160.

Figure 18:
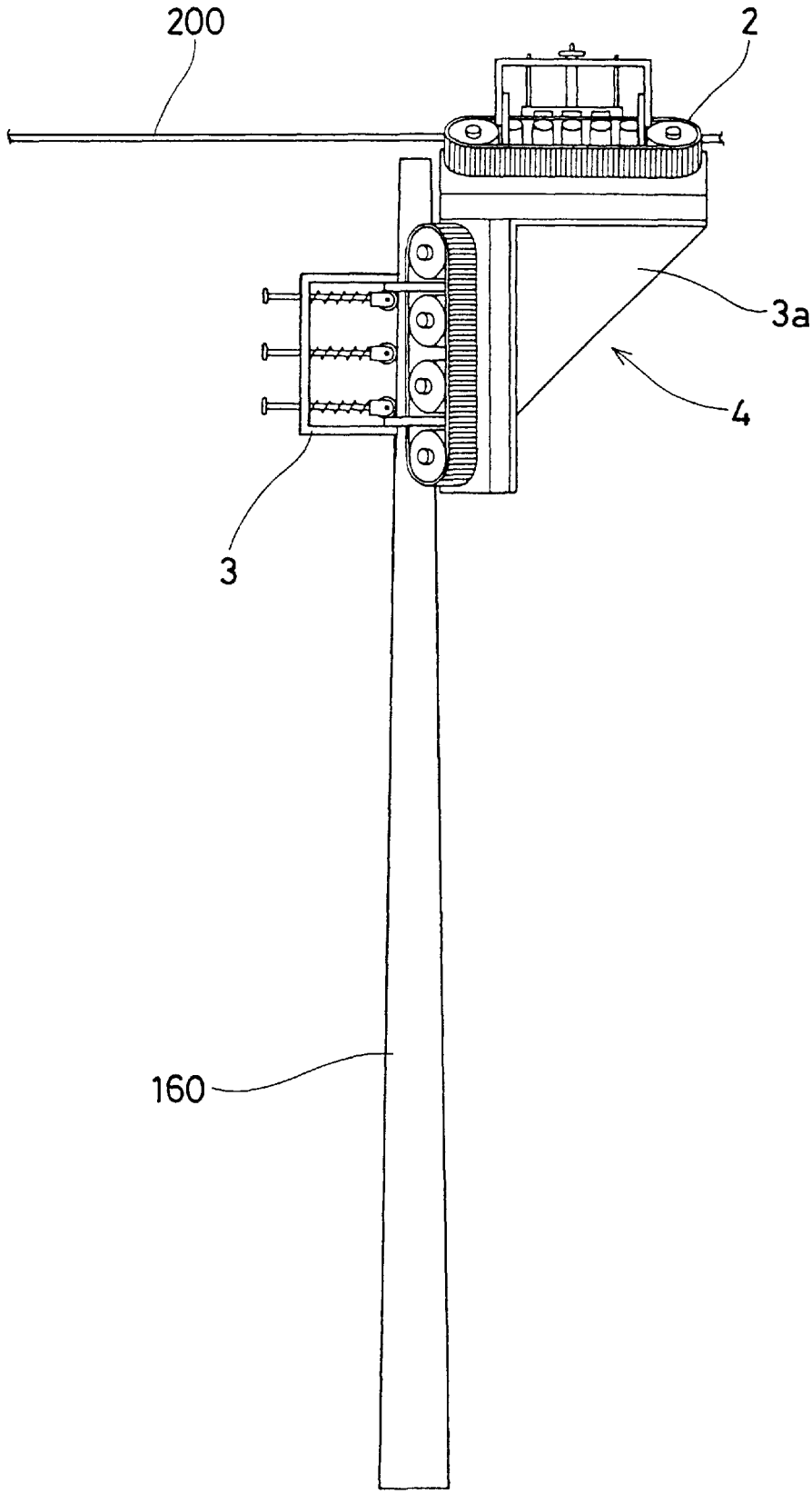
FIG. 18 shows the object transport apparatus according to the third embodiment for explaining a method of using the apparatus, the apparatus climbing up along a pole to its head while holding a cable perpendicularly to the cable.

By employing such a method of use, as shown in FIG. 18, object transport apparatus 3 can climb up to the head of pole 160 by means of frictional forces between pole 160 and transport belts 40*a* and 40*b* and press wheel 66 while object transport apparatus 2 at the head of pole 16 can transport a cable 200 perpendicularly to pole 160. As a result, compared with the conventional method shown in FIG. 23 in which cable 200 is transported while being pulled in the region of the bottom part of pole 160, a smaller gravity is exerted from the cable on object transport system 4. Accordingly, the load on object transport system 4 is reduced.

Figure 19:
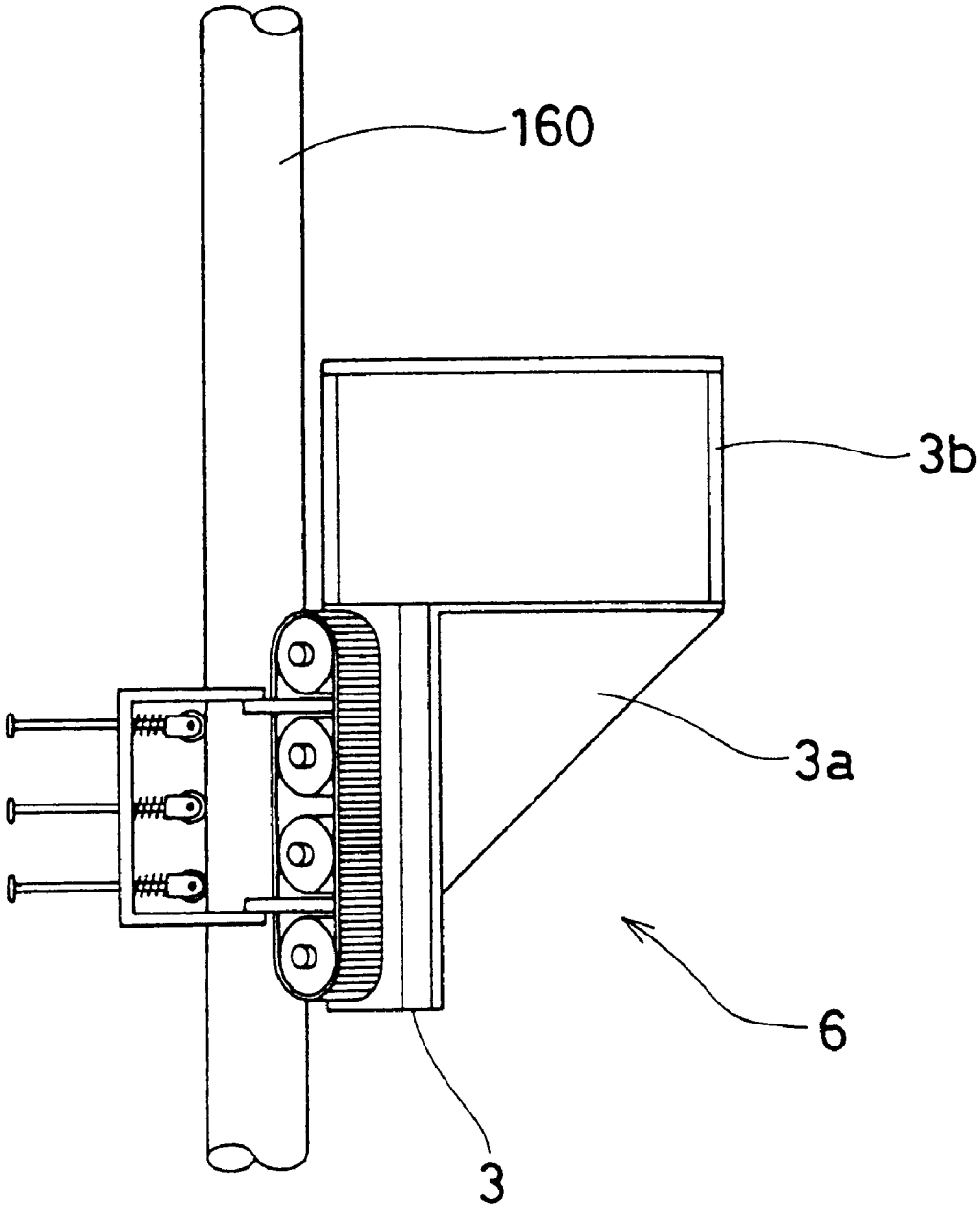
FIG. 19 shows the object transport apparatus according to the third embodiment for explaining a method of using the apparatus, the apparatus transporting a basket to the head of a pole.

As shown in FIG. 19, object transport apparatus 3 pressed against pole 160 can be combined with a basket 3*b* with triangular plate 3*a* therebetween, basket 3b being fixed perpendicularly to transport apparatus 3. This use enables tools and the like to be supplied to a worker at the head part of pole 160.

Figure 20:
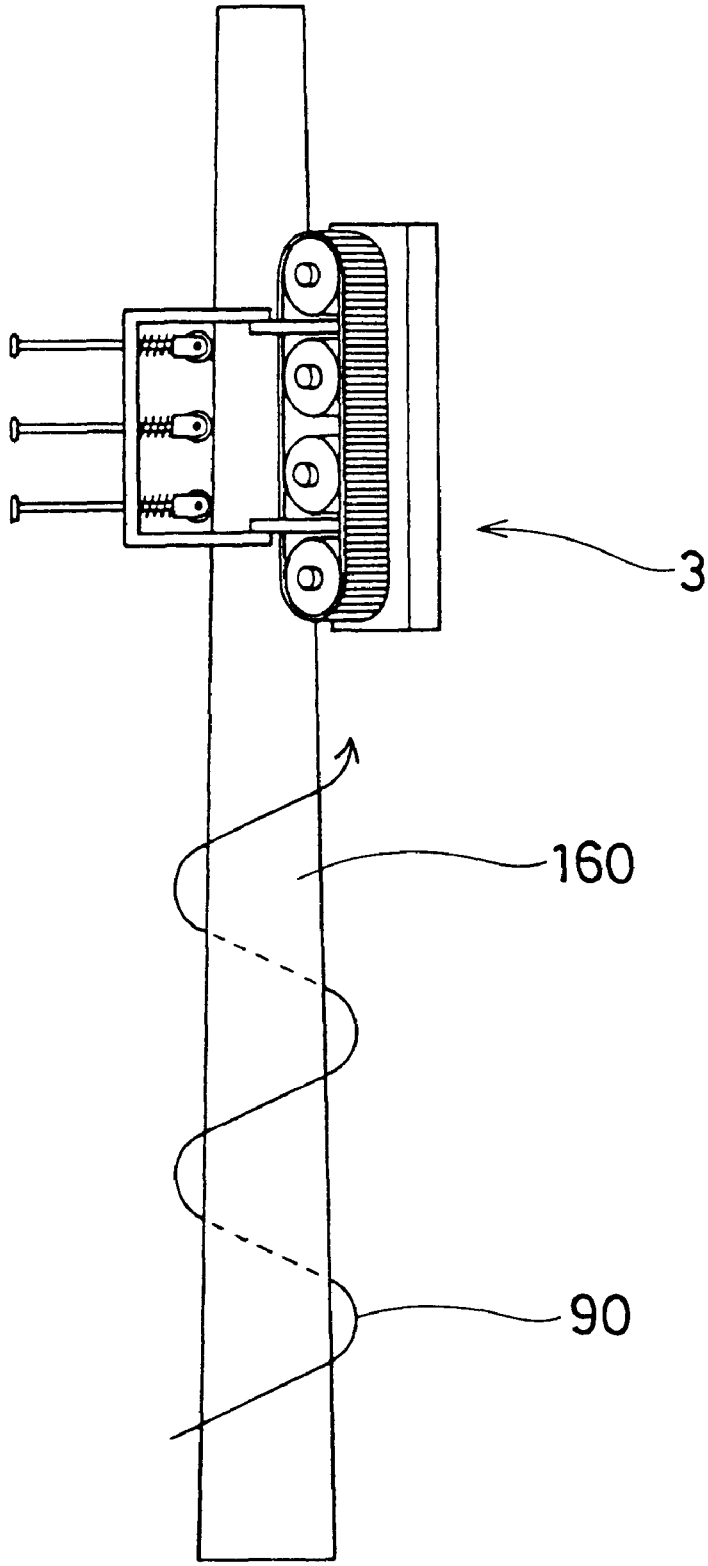
FIG. 20 shows the object transport apparatus according to the third embodiment for explaining a method of using the apparatus, the apparatus climbing up a pole in a spiral manner.

Further, as shown in FIG. 20, the speeds of rotation of transport belts 40*a* and 40*b* can be made different from each other to allow the transport apparatus to climb up pole 160 in a spiral manner. This use of the transport apparatus enables a wire, rope and the like, for example, to be wound around the pole in a spiral manner. The rope, wire and the like installed on pole 160 in this manner thus will never sway if it is blown by the wind.

Figure 21:
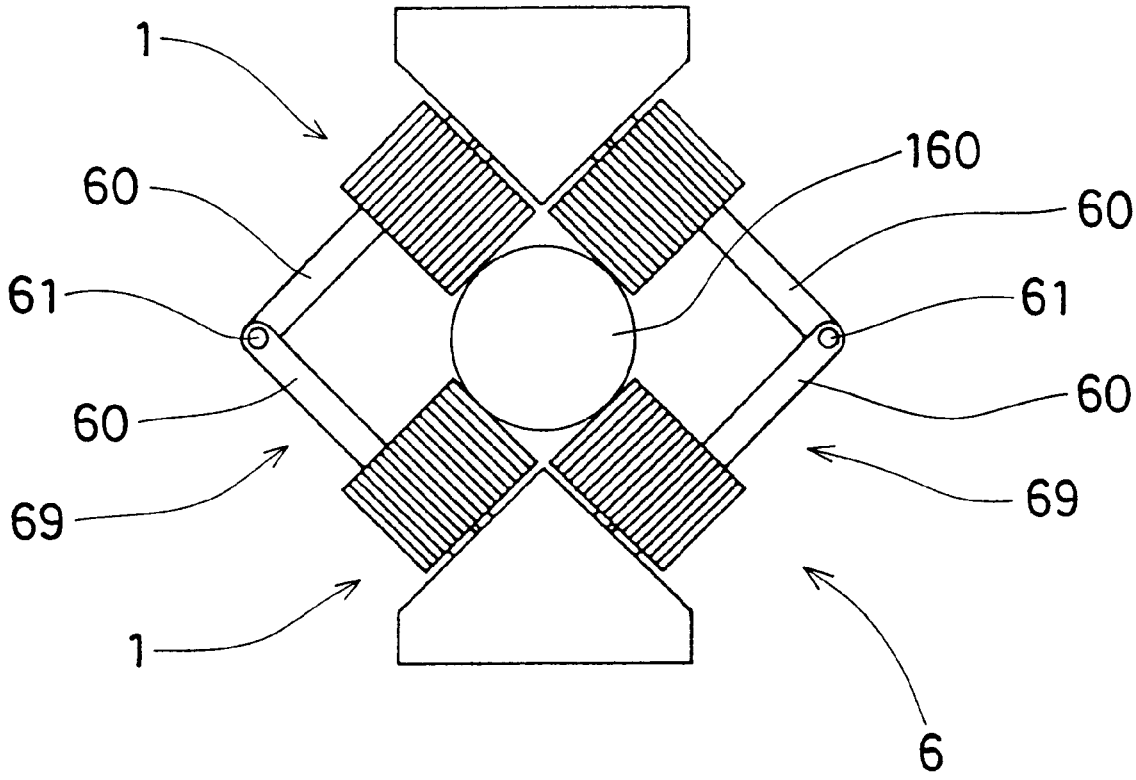
FIG. 21 shows object transport apparatuses according to the third embodiment for explaining a method of using the apparatuses, two object transport apparatuses being used to climb up a pole, and the apparatuses viewed in a cross section of the pole.

As shown in FIG. 21, an object transport system 6 constituted of two object transport apparatuses 1 can be used to climb up pole 160 while catching pole 160 therein and pressing pole 160. By using the object transport system in this way, transport belts 40*a* and 40*b* of two object transport apparatuses 3 can be brought into contact with pole 160 to cause a greater frictional force compared with use of one object transport apparatus 3 having transport belts 40*a* and

Figure 22:
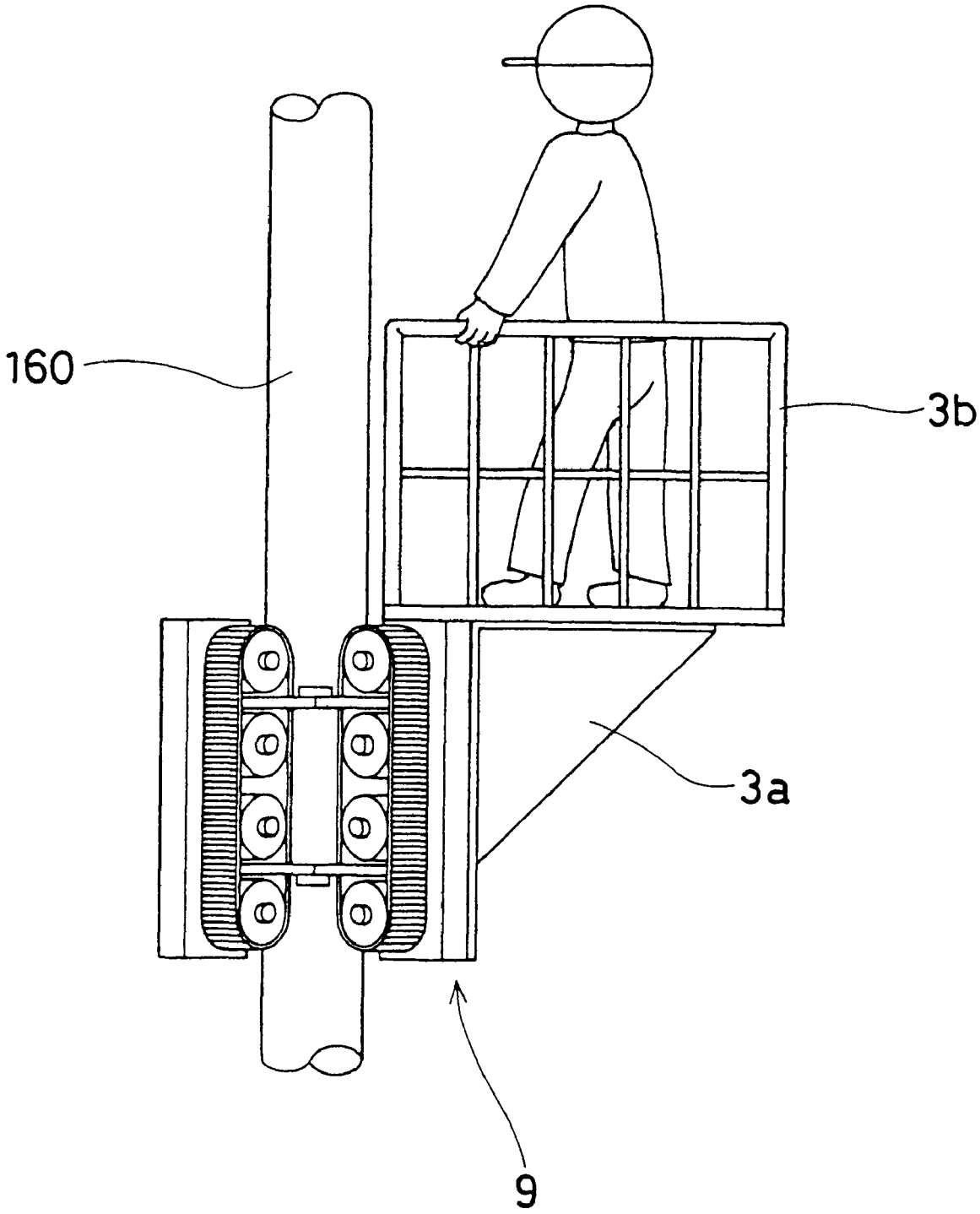
FIG. 22 shows object transport apparatuses according to the third embodiment for explaining a method of using the apparatuses, two object transport apparatuses being used for transporting a person to the top of a pole.

40*b* and wheel 66 of press section 69 being in contact with pole 160. Accordingly, as shown in FIG. 22, an object transport apparatus 9 having a basket 3*b* with a triangular plate 3*a* therebetween can transport a person and the like to the head of pole 160.

The object transport apparatus according to this embodiment is operated by a wireless system such as the one enabling remote control from the ground for moving the object transport apparatus while pressing the apparatus against the pole.

According to the first to the third embodiments discussed above, the object transport apparatuses are described to use the transport belts circulating while keeping contact with a plurality of wheels or winding therearound. However, the same effects as those of the first to the third embodiments can be achieved by a cable transport apparatus having no transport belt and having a V-shaped space formed by two wheels with respective rotational axes crossing each other so as to transport a cable in the V-shaped space.

The present invention has been described in detail, and it will clearly be understood that the description is for illustration only and does not intend limitation, the spirit and scope of the invention being limited by the attached scope of claims only.

Industrial Applicability

The object transport apparatus of the present invention is used for transporting objects having respective cross sections different in size from each other and particularly used for transporting electric cables having different diameters respectively. The apparatus is especially suitable for transporting a cable such as optical fiber cable that has a weak tensile strength and thus deviation of the cable cannot be avoided by forcibly applying tensile force.

What is claimed is:

1. An object transport apparatus for transporting an object by frictionally contacting a surface of the object, said apparatus comprising:

a pedestal (10) having a first surface (15*a*) and a second surface (15*b*) continuing with a predetermined angle therebetween;

a transport unit (5) provided on said first and second surfaces (15*a*, 15*b*) respectively and adapted to frictionally contact the surface of the object (100, 200) to transport the object (100, 200); and a drive mechanism connected to said transport unit and adapted to rotationally drive said transport unit so as to transport the object;

wherein said drive mechanism comprises:

a first spur gear (14*b*) and a first bevel gear (12*b*) rotating about a common rotational axis by a drive force;

a second bevel gear (22*b*) engaging with said first bevel gear (12*b*);

a second spur gear (14*a*) engaging with said first spur gear (14*b*);

a third bevel gear (12*a*) integrally rotating about a rotational axis common to said second spur gear (14*a*); and a fourth bevel gear (22*a*) engaging with said third bevel gear (12*a*); and wherein said transport unit (5) includes:

first power transmission means having a plurality of first cylindrical members (25*a*, 25*c*) rotating respectively about a plurality of first rotational axes (20*a*, 20*c*) substantially perpendicular to said first surface (15*a*) and in parallel with each other, and second power transmission means having a plurality of second cylindrical members (25*b*, 25*d*) rotating respectively about a plurality of second rotational axes (20*b*, 20*d*) substantially perpendicular to said second surface (15*b*) and in parallel with each other, and first and second belt-like transport members (40*a*, 40*b*) contacting or winding around respective Peripheries of said first and second cylindrical members (25*a*, 25*c*, 25*b*, 25*d*) of said first and second power transmission means respectively to circulate around said first and second power transmission means.

2. The object transport apparatus according to claim 1, wherein said first belt-like transport member (40*a*) has a side of a transport surface located on said pedestal (10) and contacting the object (100, 200) and said second belt-like transport member (40*b*) has a side of a transport surface located on said pedestal (10) and contacting the object (100, 200), said respective sides being in parallel and adjacent to each other.

3. The object transport apparatus according to claim 1, further comprising object press means (8) including a third cylindrical transport member (55) that has a peripheral surface pressing the object (100, 200) and that is provided to rotate following transport of the object (100, 200).

4. The object transport apparatus according to claim 3, wherein a plurality of said object press means (8) are provided along the direction of transporting the object (100, 200).

5. The object transport apparatus according to claim 4, further comprising a third belt-like transport member (70) circulating around said third cylindrical transport member (55) following transport of the object while winding around or contacting said third cylindrical transport member (55).

6. The object transport apparatus according to claim 3, wherein said object press means (8) includes a support section (56) fixed to said pedestal (10) and a press section (57) provided to turn around on one end of said support section (56), and wherein said press section (57) turns around to recede for stopping said pressing.

7. The object transport apparatus according to claim 3, wherein said object press means (8) includes an external thread section (52) and an internal thread section, and said object transport apparatus further includes object press force adjustment means for adjusting a length of said external thread section (52) screwed into said internal thread section in order to contact the object (100, 200) by said press means with a substantially constant pressure.

8. A method of using a first one of said object transport apparatus according to claim 3 for moving said first object transport apparatus (3) up and down along a pole-like long object (160) standing on the ground substantially perpendicularly to the ground, comprising:

holding said long object (160) with a predetermined press force at three locations of said first and second belt-like transport members (40*a*, 40*b*) and said object press means (8) of the first object transport apparatus (3), and rotationally driving said drive mechanism (7) to generate a frictional force between said first and second belt-like transport members (40*a*, 40*b*) and said object press means (8) and said long object (160) and move the said first object transport apparatus up and down along said long object (160).

9. The method according to claim 8, using said first object transport apparatus (3) and a second one of said object transport apparatus (2) that is fixed with respect to said first object transport apparatus (3) to transport a second object in a direction substantially perpendicularly to the direction of transporting by said first object transport apparatus (3), and said second object transport apparatus (2) transports a second object (200) substantially perpendicularly to said long object.

10. The method of using the object transport apparatus according to claim 8, wherein the ratio between respective rotational speeds of said first and second power transmission means is changed to move said object transport apparatus (3) helically up and down along said long object.

11. A method of using two of the object transport apparatus according to claim 1, for moving said two object transport apparatuses (6) up and down along a pole-like long object (160) standing on the ground substantially perpendicularly to the ground comprising:

placing said two object transport apparatuses (6) opposite to each other such that said first and second belt-like transport members (40*a*, 40*b*) of each said object transport apparatus (6) form a contact surface contacting the long object, and wherein respective contact surfaces contacting the long object face each other, and pressing the long object (160) held between the first and second belt-like transport members (40*a*, 40*b*) of said two object transport apparatuses (6) and rotationally driving said drive mechanism (7) to generate a frictional force of said transport members and move said object transport apparatuses up and down along the long object.

12. An object transport apparatus for transporting an object by frictionally contacting a surface of the object, said apparatus comprising:

a pedestal (10) having first and second surfaces (15*a*, 15*b*) continuing with a predetermined angle therebetween;

a transport unit (5) provided on said first and second surfaces (15*a*, 15*b*) respectively and adapted to frictionally contact the surface of the object (100, 200) to transport the object, wherein said transport unit (5) includes:

first power transmission means having a first cylindrical member (25*a*) rotating about a first rotational axis (20*a*) substantially perpendicular to said first surface (15*a*), and second power transmission means having a second cylindrical member (25*b*) rotating about a second rotational axis (20*b*) crossing said first rotational axis (20*a*) and substantially perpendicular to said second surface (15*b*); and a drive mechanism connected to said transport unit and adapted to rotationally drive said transport unit so as to transport the object, wherein said drive mechanism comprises:

a first spur gear (14*b*) and a first bevel gear (12*b*) rotating about a common rotational axis by a drive force, a second bevel gear (22*b*) engaging with said first bevel gear (12*b*), a second spur gear (14*a*) engaging with said first spur gear (14*b*), a third bevel gear (12*a*) integrally rotating about a rotational axis common to said second spur gear (14*a*), and a fourth bevel gear (22*a*) engaging with said third bevel gear (12*a*).

13. The object transport apparatus according to claim 12, wherein said first cylindrical member (25*a*) of said first power transmission means has an edge on said pedestal (10) and said second cylindrical member (25*b*) of said second power transmission means has an edge on said pedestal (10), said respective edges being adjacent to each other.

* * * * *